US005604086A

United States Patent [19]

Reed et al.

[11] Patent Number: 5,604,086

[45] Date of Patent: Feb. 18, 1997

[54] TABULAR GRAIN EMULSIONS CONTAINING A RESTRICTED HIGH IODIDE SURFACE PHASE

[75] Inventors: Kenneth J. Reed, Rochester; Jeffrey C. Hansen, Fairport, both of N.Y.

[73] Assignee: Eastman Kodak Company, Rochester, N.Y.

[21] Appl. No.: 620,773

[22] Filed: Mar. 22, 1996

Related U.S. Application Data

[63] Continuation-in-part of Ser. No. 412,811, Mar. 29, 1995, abandoned.

[51] Int. Cl.[6] ..... G03C 1/035

[52] U.S. Cl. ..... 430/567; 430/570; 430/604; 430/605

[58] Field of Search ..... 430/567, 570, 430/604, 605

[56] References Cited

U.S. PATENT DOCUMENTS

| | | | |
|---|---|---|---|
| 4,049,684 | 6/1978 | Maskasky | 96/108 |
| 4,142,900 | 3/1979 | Maskasky | 96/94 R |
| 4,158,565 | 6/1979 | Maskasky | 96/29 D |
| 4,399,215 | 8/1983 | Wey | 430/567 |
| 4,400,463 | 8/1983 | Maskasky | 430/434 |
| 4,425,425 | 1/1984 | Abbott et al. | 430/502 |
| 4,425,426 | 1/1984 | Abbott et al. | 430/502 |
| 4,433,048 | 2/1984 | Solberg et al. | 430/434 |
| 4,434,226 | 2/1984 | Wilgus et al. | 430/567 |
| 4,439,520 | 3/1984 | Kofron et al. | 430/434 |
| 4,459,353 | 7/1984 | Maskasky | 430/567 |
| 4,490,458 | 12/1984 | House | 430/503 |
| 5,021,323 | 6/1991 | Yamamoto | 430/292 |
| 5,061,609 | 10/1991 | Piggin et al. | 430/569 |
| 5,061,616 | 10/1991 | Piggin et al. | 430/569 |
| 5,314,798 | 5/1994 | Brust et al. | 430/567 |
| 5,418,124 | 5/1995 | Suga et al. | 430/567 |
| 5,536,632 | 7/1996 | Wen et al. | 430/567 |

*Primary Examiner*—Mark F. Huff
*Attorney, Agent, or Firm*—Carl O. Thomas

[57] ABSTRACT

A photographic emulsion is disclosed comprised of a dispersing medium and radiation-sensitive silver halide grains with greater than 50 percent of total grain projected area being accounted for by grains containing a host portion of a face centered cubic rock salt crystal lattice structure and a first epitaxial phase containing greater than 90 mole percent iodide. The host portion is tabular, being bounded by an exterior having first and second parallel major faces joined by a peripheral edge. The first epitaxial phase accounts for less than 60 percent of total silver, and the first epitaxial phase is restricted to a portion of the exterior of the host portion that includes at least 15 percent of the major faces.

20 Claims, 8 Drawing Sheets

1 μm 0.25μm 1.0 μm 0.1 μm

TABULAR GRAIN EMULSIONS CONTAINING A RESTRICTED HIGH IODIDE SURFACE PHASE

This is a continuation-in-part of U.S. Ser. No. 08/412,811, filed Mar. 29, 1995, now abandoned.

FIELD OF THE INVENTION

The invention is directed to an improvement in photographic emulsions containing radiation-sensitive intermediate and higher aspect ratio tabular grains.

SUMMARY OF DEFINITIONS

In referring to silver halide emulsions, grains and grain regions containing two or more halides, the halides are named in order of ascending concentrations.

All references to the mole percentages of a particular halide in silver halide are based on total silver present in the grain, grain region or emulsion being discussed.

The symbol "μm" is employed to denote micrometers.

The "equivalent circular diameter" (ECD) of a grain is diameter of a circle having an area equal to the projected area of the grain.

The "aspect ratio" of a silver halide grain is the ratio of its ECD divided by its thickness (t).

The "average aspect ratio" of a tabular grain emulsion is the quotient of the mean ECD of the tabular grains divided by their mean thickness (t).

The term "tabular grain" is defined as a grain having an aspect ratio of at least 2.

The term "tabular grain emulsion" is defined as an emulsion in which at least 50 percent of total grain projected area is accounted for by tabular grains.

The terms "thin" and "ultrathin" in referring to tabular grains and emulsions are employed to indicate tabular grains having thickness of <0.2 μm and <0.07 μm, respectively.

The term "dopant" refers to a material other than silver or halide ion contained in a silver halide crystal lattice structure.

All periods and groups of elements are assigned based on the periodic table adopted by the American Chemical Society and published in the *Chemical and Engineering News*, Feb. 4, 1985, p. 26, except that the term "Group VIII" is employed to designate groups 8, 9 and 10.

The term "meta-chalcazole" is employed to indicate the following ring structure:

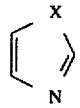

where X is one of the chalcogens: O, S or Se.

All spectral sensitizing dye oxidation and reduction voltages were measured in acetonitrile against a Ag/AgCl saturated KCl electrode, as described in detail by J. Lenhard *J. Imag. Sci.*, Vol. 30, #1, p. 27, 1986. Where oxidation or reduction potentials for spectral sensitizing dyes were estimated, the method employed was that described by S. Link "A Simple Calculation of Cyanine Dye Redox Potentials", Paper F15, International East-West Symposium II, Oct. 30–Nov. 4, 1988.

The term "inertial speed" refers to the speed of a silver halide emulsion determined from its characteristic curve (a plot of density vs. log E, where E represents exposure in lux-seconds) as the intersection of an extrapolation of minimum density to a point of intersection with a line tangent to the highest contrast portion of the characteristic curve. The inertial speed is the reciprocal of the exposure at the point of intersection noted above.

Speeds are reported as relative log speeds, where a speed difference of 1 represents a difference of 0.01 log E, where E is exposure in lux-seconds.

*Research Disclosure* is published by Kenneth Mason Publications, Ltd., Dudley House, 12 North St., Emsworth, Hampshire P010 7DQ, England.

Background

Maskasky U.S. Pat. Nos. 4,094,684, 4,142,900 and 4,158,565 (collectively referred to as Maskasky I) disclose emulsions in which silver chloride is epitaxially deposited on nontabular silver iodide host grains. These patents are generally credited as the first suggestion that a silver iodide phase can be relied upon for photon capture while a developable latent image is formed in an epitaxially joined lower iodide portion of the grain. When a photon is captured within the iodide portion of the grain, a hole (photohole) and a conduction band electron (photoelectron) pair are created. The photoelectron migrates across the epitaxial junction to form a latent image in the lower iodide portion of the grain. On the other hand, the photohole remains trapped within the silver iodide phase. Thus, the risk of dissipation of absorbed photon energy by hole-electron recombination is minimized. House U.S. Pat. No. 4,490,458 and Maskasky U.S. Pat. No. 4,459,353 (collectively referred to as House and Maskasky) later placed silver chloride epitaxy on silver iodide tabular grains to combine the advantages of Maskasky I with those known to flow from a tabular grain configuration. Although the Maskasky I and the House and Maskasky emulsions offer superior performance compared to emulsions with grains consisting essentially of a high (>90 mole percent) iodide silver halide phase, the performance of none of these emulsions has been sufficiently attractive to lead to commercial use in photography. The ratio of iodide to the remaining halide(s) is unattractively high while photographic speed and developability, though superior to grains consisting essentially of a high iodide silver halide phase, are slow.

Between the investigations of Maskasky I and those of House and Maskasky, a marked advance took place in silver halide photography based on the discovery that a wide range of photographic advantages, such as improved speed-granularity relationships, increased covering power both on an absolute basis and as a function of binder hardening, more rapid developability, increased thermal stability, increased separation of native and spectral sensitization imparted imaging speeds, and improved image sharpness in both mono- and multi-emulsion layer formats, can be realized by increasing the proportions of selected tabular grain populations in photographic emulsions. The tabular grains were initially selected to have a high (>8) average aspect ratio or at least an intermediate (5–8) average aspect ratio. The tabular grains were those having a face centered cubic rock salt crystal lattice structure (hereinafter referred to as an FCCRS crystal lattice structure), which a high iodide silver halide composition does not form, except under extreme conditions having no relevance to photography. Silver chloride, silver bromide and mixtures thereof in all ratios form an FCCRS crystal lattice structure. An FCCRS crystal lattice can accommodate minor amounts of iodide. The highest reported levels of photographic performance have been obtained with tabular grain emulsions containing silver iodobromide grains. Early disclosures of high and intermediate aspect ratio tabular grain emulsions with FCCRS crystal lattices are illustrated by Kofron et al U.S. Pat. No. 4,439,520, Wilgus et al U.S. Pat. No. 4,434,226 and Abbott et al U.S. Pat. Nos. 4,425,425 and 4,425,426.

Solberg et al U.S. Pat. No. 4,433,048 demonstrated that silver iodobromide high aspect ratio tabular grain emulsions with superior speed-granularity relationships can be prepared by increasing the iodide concentration in a region of the tabular grain laterally displaced from a central region. Solberg et al most extensively discussed and demonstrated the effect of gradually increasing the iodide concentration in the FCCRS crystal lattice of the tabular grain as lateral growth onto the edges of the tabular grains occurred.

As an alternative, Solberg et al suggested abruptly introducing silver and iodide ions, preferably after 75 to 97 percent of the total silver forming the grain had been precipitated. Solberg et al reported that, in some instances, the edges of the grains appeared castellated following abrupt iodide addition. Abrupt iodide addition has subsequently come to be referred to in the art as "dump" iodide addition, which means simply that the iodide ion is added to the grains as rapidly as possible, as opposed to being introduced at an intentionally limited flow rate, referred to as a "run" iodide addition.

It is generally understood that silver and iodide ions are concurrently introduced when iodide is being incorporated in the crystal structure of an intermediate or high aspect ratio tabular grain. If iodide ion alone is introduced into an intermediate or high aspect ratio tabular grain emulsion containing a FCCRS crystal structure, the effect is to destroy the tabular nature of the grains. Since iodide is a much less soluble compound than either silver chloride or silver bromide, the addition of iodide ion unaccompanied by silver ion results in the displacement of the previously incorporated halide ions. In other words, halide conversion occurs. Since silver iodide is a much larger ion than either chloride or bromide ion, a massive disruption of the crystal structure occurs, resulting in massive degradation or complete destruction of the tabular shape of the grains. Warnings against halide conversion in preparing tabular grain emulsions are provided by Wey U.S. Pat. No. 4,399,215 and Maskasky U.S. Pat. No. 4,400,463. Yamamoto et al U.S. Pat. No. 5,021,323, which prepares core-shell grains by the addition of potassium iodide alone to effect halide conversion for shell formation, teaches the selection of host grains having an aspect ratio of not more than 5.

Piggin et al U.S. Pat. Nos. 5,061,609 and 5,061,616 teach the formation of silver iodobromide tabular grain emulsions that exhibit reduced pressure sensitivity as a result of forming laminae on the major faces of tabular grains. The laminae have a FCCRS crystal lattice structure and contain iodide in concentrations ranging from 10 mole percent, based on silver, up to the saturation limit (approximately 40 mole %) of iodide in the FCCRS crystal lattice structure. Piggin et al '609 forms the laminae by any convenient technique and then shells the laminae with silver bromide deposition within a specified pAg and temperature parameter boundary. Piggin et al '616 first adjusts a tabular grain emulsion to satisfy the same pAg and temperature parameter boundary of Piggin et al '609. This rounds the corners of the tabular grains. Silver iodide then deposits at the rounded corners of the tabular grains and can restore the corners to their original configuration. Thereafter, while still within the pAg and temperature parameter boundary, silver iodobromide is precipitated onto the major faces of the host tabular grains. Concurrently the previously precipitated silver iodide is redistributed and incorporated in the FCCRS crystal lattice structure of the laminae.

Brust et al U.S. Pat. No. 5,314,798 discloses the preparation of high chloride {100} tabular grain emulsions in which the tabular grains are comprised of a core and a surrounding band containing a higher level of iodide ions and containing up to 30 percent of the silver in the tabular grains. Brust et al speculates in column 9, lines 10 to 16, that a separate silver iodide phase may form, but no separate silver iodide phase in the completed emulsions has been observed. A separate iodide phase has been observed at the edges of the tabular grains, but not on their major faces, during precipitation, but this separate silver iodide phase disappeared as precipitation continued.

Suga et al U.S. Pat. No. 5,418,124 discloses an emulsion in which silver halide have been formed while iodide ions are rapidly being generated in a reaction vessel to form a silver iodide-containing region as an edge fringe portion that contains 10 or more dislocations per grain. The edge location of the silver iodide exhibits limited light absorption.

Problem to be Solved

Notwithstanding the many advances imparted to photographic imaging by silver iodobromide intermediate and high aspect ratio tabular grain emulsions, some shortcomings have been observed. Intermediate and high aspect ratio tabular grain emulsions work best when applied to minus blue (green and/or red) imaging, since they provide large surface areas in relation to grain volume for minus blue absorbing spectral sensitizing dyes. The silver halide itself lacks native minus blue sensitivity; hence reducing silver coating coverages while maintaining large surface areas for spectral sensitizing dye adsorption saves silver with little negative impact on imaging.

By comparison, the application of intermediate and high aspect ratio tabular grain emulsions to forming blue exposure records has lagged. The reason is that traditionally the native blue sensitivity of silver iodobromide grains has been heavily relied upon for latent image formation, even when blue spectral sensitizing dyes have been employed in combination with the grains. Attempts to realize the silver savings in blue recording emulsion layers that are routinely realized in minus blue recording emulsion layers by employing intermediate and high aspect ratio tabular grain emulsions have resulted in speed penalties. The problem is exacerbated by the fact that, while daylight contains an equal amount of its total energy in the blue, green and red regions of the visible spectrum, blue photons contain more energy than either green and red photons; hence, daylight has available fewer blue photons than green or red photons for latent image formation. The problem cannot be corrected by simply increasing the levels of blue spectral sensitizing dye, since additional speed enhancement is not realized by dye additions beyond those that can be adsorbed to the grain surfaces. Kofron et al suggests increasing the maximum thickness of tabular grains from 0.3 μm to 0.5 μm to enhance their blue absorption. In the highest speed multicolor photographic elements it is common for the fastest minus blue recording emulsion layers to be formed using tabular grain emulsions while the fastest blue recording emulsion layer employs nontabular grains. Since the highest speed blue recording layer is typically the first emulsion layer to receive exposing radiation, there is a significant negative impact by the nontabular grains on the sharpness of the images in all of the remaining emulsion layers.

Another problem inherent in the conventional choices of silver iodobromide tabular grain emulsions is that the techniques disclosed by Maskasky I for photohole and photoelectron separation, with attendant reduction in their recombination, have been largely unrealized. Conventional tabular grains either contain no high iodide silver halide phase or have limited its extent to a small band at the edge of the tabular grain.

SUMMARY OF THE INVENTION

In one aspect the invention is directed to a photographic emulsion comprised of a dispersing medium and radiation-sensitive silver halide grains with greater than 50 percent of total grain projected area being accounted for by grains containing a host portion of a face centered cubic rock salt crystal lattice structure and a first epitaxial phase containing greater than 90 mole percent iodide, wherein the host portion is tabular, being bounded by an exterior having first and second parallel major faces joined by a peripheral edge, the first epitaxial phase accounts for less than 60 percent of total silver, and the first epitaxial phase is restricted to a portion of the exterior of the host portion that includes at least 15 percent of the major faces.

The emulsions of the invention offer advantages that have heretofore been unrealized in providing intermediate and high aspect ratio tabular grain emulsions for photographic imaging.

Restriction of the first epitaxial phase to a portion of the external surface of the host tabular grains allows latent image formation and development initiation at relatively low iodide sites on the surfaces of the grains. This translates into higher levels of photographic performance, particularly better utilization of the latent image. By leaving at least a portion of the tabular grain edge surfaces free of the first epitaxial phase, as is preferred, ideal, low iodide sites for latent image formation are provided.

The location of the first epitaxial phase over at least 15 percent (preferably at least 25 percent) of the surface area of the major faces of the host tabular grains optimally positions this high iodide phase for absorption of short (400 to 450 nm) blue light. With only thin plates of the high iodide first epitaxial phase short blue absorptions far exceeding those attainable with adsorbed spectral sensitizing dye are realized. By combining the tabular grains of the invention with spectral sensitizing dye exhibiting blue absorption maxima (hereafter referred to as blue spectral sensitizing dyes) even higher blue speeds can be realized. By employing the tabular grain emulsions of the invention in combination with long (450 to 500 nm) blue absorption maxima spectral sensitizing dyes, increased levels of light capture over the entire blue portion of the spectrum can be realized.

The tabular grain emulsions of the invention are, in fact, so efficient in blue absorption that it is possible to eliminate from a multicolor photographic element underlying blue filter layers customarily incorporated to protect minus blue recording emulsion layers from unwanted blue exposure, while still avoiding objectionable blue contamination of the minus blue recording records.

Whereas, it has been frequently suggested to incorporate iodide in silver iodobromide tabular grain emulsions in concentrations up to iodide saturation, about 40 mole percent iodide, superior blue light absorption can be realized by the emulsions of the invention with lower overall levels of iodide.

Yet another advantage of the emulsions of the invention is that sites are distributed over the major faces of the tabular grains for photohole capture and separation from photoelectrons. This reduces the risk of photohole-photoelectron recombination and increases latent image forming efficiency in both the blue and minus blue regions of the spectrum.

DESCRIPTION OF PREFERRED EMBODIMENTS

At least 50 percent of the total grain projected area of emulsions according to the invention is accounted for by composite silver halide grains having two readily distinguishable portions, a host portion that is tabular and at least a first epitaxial phase restricted to only a portion of the host exterior, but overlying at least 15 percent (preferably at least 25 percent) of the major faces of the host tabular grains. The host tabular grains exhibit a face centered cubic rock salt crystal lattice structure (an FCCRS crystal lattice structure) while the first epitaxial phase forms a separate silver halide phase containing greater than 90 mole percent iodide, hereinafter referred to as a high iodide silver halide phase. The first epitaxial phase accounts for less than 60 (preferably less than 25) percent of total silver forming the composite grains.

Figure 1:
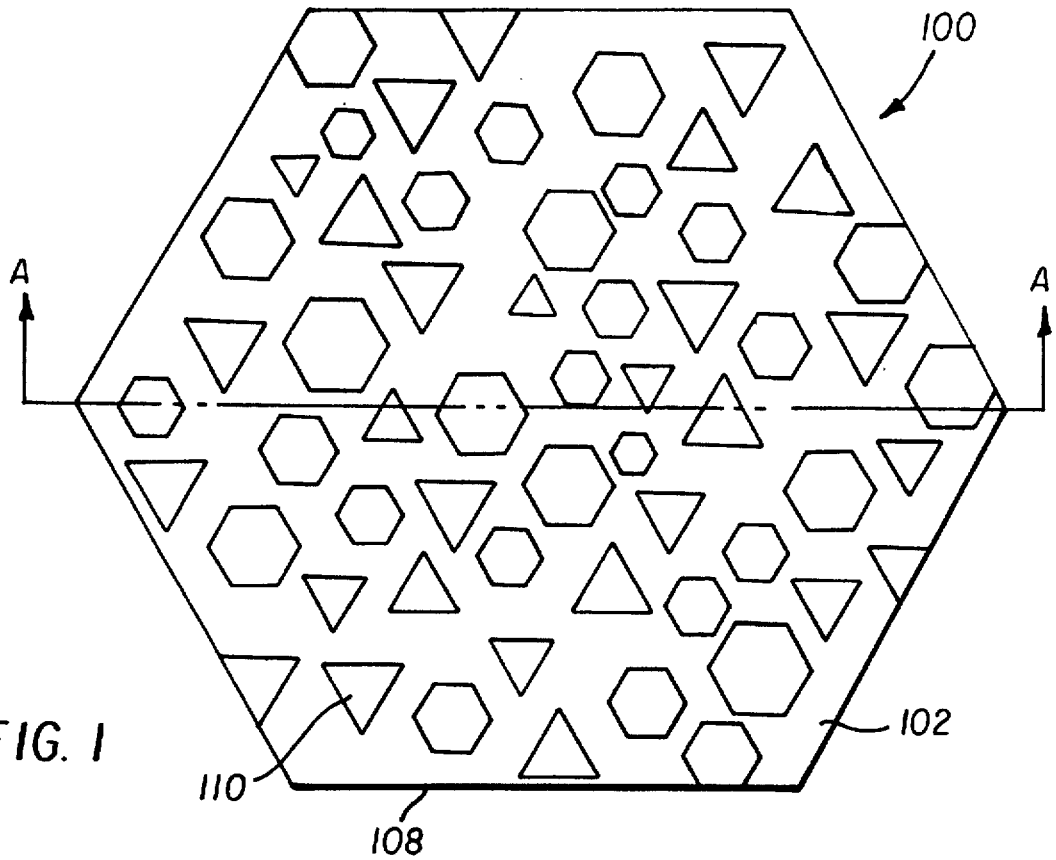
FIG. 1 is a schematic plan view of a tabular grain satisfying the requirements of the invention.
Figure 2:
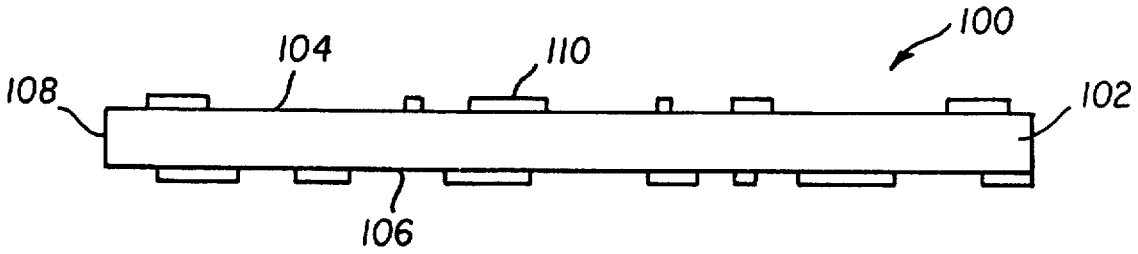
FIG. 2 is a schematic sectional view along section line A—A in FIG. 1.

A typical composite grain structure 100 is schematically shown in FIGS. 1 and 2. A host tabular grain portion 102 is bounded by an upper major face 104 and a lower major face 106 joined by a laterally surrounding peripheral edge 108, schematically shown. Epitaxially grown on the major faces of the host tabular grain are discrete plates 110, shown to have triangular and hexagonal boundaries. The plates contain the first epitaxial phase. Notice that the plates overlie at least 15 percent of the surface area of the major faces of the tabular grain, yet are restricted in their areal extent so that portions of the tabular grain exterior remain free of the plates.

As is well understood in the art, tabular grains are oriented with their major faces approximately normal to the direction of light transmission during imagewise exposure in a photographic element. When the grain 100 is exposed to light in the short (400 to 450 nm) blue region of the spectrum, photons are initially absorbed preferentially (and in some cases entirely) in the plates 110 on the major faces 104 and 106 of the host tabular grain portion 102. The plates on both the major face nearer to and farther from the source of exposing short blue light actively absorb short blue photons, since the host tabular grain portion cannot absorb more than a small fraction of the exposing short blue light and unabsorbed light is transmitted through the host tabular grain portion.

Measured along the section line A—A, the plates as shown in FIG. 2 overlie 35% of the upper major face and 48% of the lower major face. Notice that the plates on the upper and lower major faces are not aligned. At some points a short blue photon encounters no plate in passing through the composite grain, in other areas one plate, and in remaining areas two plates. As shown the upper and lower plates are positioned to intercept 71% of photons incident along section line A—A.

It should be noticed that location of the plates on the major faces of the host tabular grain portion is an ideal orientation for short blue photon absorption. In this orientation the plates present a maximum target area for the photons. If the plates were instead located entirely on the peripheral edge 108 of the host tabular grain portion, they would present a much smaller target area and fewer short blue photons would be absorbed. Although the ideal is to eliminate edge plates, as shown, it is recognized that in practice plates are usually located to some extent on both the edge and major face of the host tabular grain exterior. However, techniques are described below for minimizing the proportion of the plates located along the peripheral edge.

If, instead of forming a high iodide silver halide phase on the surface of the tabular grain portion, the tabular grain portion is simply optimally sensitized with a spectral sensitizing dye having a short blue absorption maxima (hereinafter referred to as a short blue spectral sensitizing dye), the highest blue light absorption attainable without desensitization is still much less than that which can be obtained by employing the first epitaxial phase as described. Maximum light absorption by an optimally spectrally sensitized tabular grain is typically in the 10 to 15 percent range. By contrast, the epitaxial phase can produce short blue light absorptions in each grain that are well in excess of 50 percent. Since in emulsion coatings the path of exposing radiation intercepts a plurality of grains, it is appreciated that capture of short blue photons can approach 100 percent when the emulsions of the invention are employed. Nevertheless, to reduce the amount of silver required in coating, it is specifically contemplated to employ an emulsion according to the invention in combination with one or more conventional short blue spectral sensitizing dyes.

When a blue spectral sensitizing dye (a dye having an absorption maximum in the 400–500 nm spectral region) is selected for a conventional tabular grain emulsion, a theoretically ideal choice is a dye having a half-peak bandwidth (a spectral wavelength range over which it exhibits an absorption of at least half its maximum absorption) of 100 nm, extending from 400 to 500 nm. In practice, few spectral sensitizing dyes exhibit 100 nm half peak bandwidths, nor are actual half peak bandwidths coextensive with the blue region of the spectrum. Typical blue spectral sensitizing dyes exhibit half peak bandwidths of less than 50 nm.

In a specifically preferred form of the invention it is contemplated to employ emulsions according to the invention in combination with one or more spectral sensitizing dyes having an absorption maxima in the long blue (450–500 nm) region of the spectrum (hereinafter referred to as a long blue spectral sensitizing dye). The high iodide silver halide provided by the first epitaxial phase offers peak absorption near 425 nm. When this absorption is combined with that provided by a long blue spectral sensitizing dye, a higher blue absorption over the entire blue portion of the spectrum is realized.

It is, of course, possible to employ combinations of short and long blue spectral sensitizing dyes with the tabular grain emulsions of the invention. Assuming dyes are selected of equal efficiencies, when this is undertaken, the proportion of total sensitivity provided by the combination of blue spectral sensitizing dyes is no higher and usually somewhat less than that which can be obtained by employing the long blue spectral sensitizing dye alone.

When, in the absence of a spectral sensitizing dye, a short blue photon is absorbed by a plate, a photohole and a photoelectron pair are created. The photoelectron is free to migrate across the epitaxial junction into the host tabular grain portion. On the other hand, the photohole is trapped within the plate. What therefore occurs is separation of the photoelectron from the photohole, which in turn minimizes the risk of their mutual annihilation by recombination. Thus, the plates contribute to larger numbers of photoelectrons being available for latent image formation and enhance the overall sensitivity of the emulsion grains.

When a spectral sensitizing dye of any absorption maxima is employed in combination with the composite grains of the invention, the high iodide silver halide phase still contributes to enhanced emulsion sensitivity. Longer wavelength photons are initially absorbed by the spectral sensitizing dye and the dye injects the absorbed energy into the plates directly or into the host tabular grain portions. The photohole remaining in the dye migrates into the plate. Notice that this mechanism applies regardless of the spectral region of exposure. That is, the plates can improve the latent image forming efficiency of emulsions that are sensitized to the minus blue (green and/or red) portion of the spectrum as well as improving imaging efficiency in the blue region of the spectrum.

Although any conventional spectral sensitizing dye is capable of injecting electrons into the host tabular grain portions with which it is in contact, electron injection into the plates can only be achieved if the reduction potential of the spectral sensitizing dye is more negative than the conduction band of the high iodide crystal structure forming the plate. Thus, for the entire major faces of the grains (those portions provided by the host tabular grains and those portions provided by the plates) to be receptive to electron injection and hence for most efficient performance it is necessary that the spectral sensitizing dye have a reduction potential more positive than a threshold value of −1.30 (preferably −1.35) volts. Spectral sensitizing dyes with reduction potentials increasingly more negative than the threshold value all perform well. Hence, the most negative reduction potentials of spectral sensitizing dyes contemplated are dictated solely by convenience and availability. Spectral sensitizing dyes with reduction potentials to −1.80 volts are common and, for a few dyes, reduction potentials as negative as −2.0 volts have been identified. The advantages for selection of spectral sensitizing dyes with reduction potentials more negative than the threshold value stated above and the resulting improvements in photographic performance are believed to be attributable to the somewhat more negative conduction band of the high iodide crystal lattice structure forming the plates as compared to the conduction band of the FCCRS crystal structure forming the plates. When combinations of spectral sensitizing dyes are employed, exceptionally efficient performance is observed with each spectral sensitizing dye has a reduction potential more negative than the threshold value stated above.

The emulsions of the invention can be prepared by starting with any conventional tabular grain emulsion in which the tabular grains exhibit an FCCRS crystal lattice structure. The starting tabular grains can consist essentially of silver bromide, silver chloride, silver chlorobromide, silver bromochloride, silver iodobromide, silver iodochloride, silver iodochlorobromide, silver iodobromochloride, silver chloroiodobromide or silver bromoiodochloride.

In one preferred form starting tabular grains are high (>50 mole %) bromide, optimally >70 mole % bromide, silver halides with chloride preferably limited to 10 mole % or less. High bromide tabular grains are less soluble than high (>50 mole %) chloride tabular grain emulsions and are therefore more resistant to halide displacement from the FCCRS crystal lattice structure on subsequent epitaxial deposition. Iodide inclusions in the starting tabular grains are preferably less than 10 mole percent, since the high iodide silver halide first epitaxial phase is capable of performing the imaging functions normally accomplished by high iodide inclusions. When iodide is included in the starting tabular grains, it can be uniformly or nonuniformly distributed in any conventional manner.

The starting tabular grains can exhibit either {111} or {100} major faces. The tabular grain 100 shown in FIGS. 1 and 2 has {111} major faces. Tabular grains with {111} major faces, hereafter referred to as {111} tabular grains, usually have triangular or hexagonal major faces. Generally, the more uniform the tabular grain population, the higher the proportion of tabular grains with hexagonal major faces. In their most highly controlled forms {111} tabular grains with adjacent edges of hexagonal major faces that differ in length by less than 2:1 account for greater than 90 percent of the total tabular grains. Corner rounding due to ripening typically ranges from barely perceptible to creating almost circular major faces. In a specifically preferred form of the invention the {111} tabular grains are also high bromide tabular grains.

Tabular grains with {100} major faces, hereafter referred to as {100} tabular grains, have square or rectangular major faces. In these emulsions a grain is normally required to have a ratio of adjacent edge lengths of 5:1 or less to be considered tabular rather than being rod-like. In a specifically preferred form of the invention the {100} tabular grains are also high chloride tabular grains. High chloride tabular grains with {100} major faces show a higher level of stability against morphological degradation than high chloride {111} tabular grains, which rely on adsorbed materials to stabilize {111} grain faces.

The starting tabular grain emulsions can have any photographically useful mean ECD, typically up to 10 μm, but preferably the tabular grain emulsions have a mean ECD of 5 μm or less. The starting tabular grains can have any thickness, ranging from the minimum reported thicknesses for ultrathin (<0.07 μm) tabular grain emulsions up to the maximum thickness compatible with a >5 average aspect ratio. It is generally preferred that the starting tabular grains have a thickness of less than 0.3 μm, more preferably, less than 0.2 μm, and, most preferably less than 0.07 μm.

The tabular grains of the starting emulsions (preferably those having a thickness of <0.3 μm, more preferably <0.2 μm, and most preferably <0.07 μm) account for greater than 50 percent, preferably greater than 70 percent and most preferably greater than 90 percent of total grain projected area. In specifically preferred starting tabular grain emulsions substantially all (greater than 97 percent) of total grain projected area can be accounted for by tabular grains.

The starting tabular grain emulsion can exhibit any conventional level of dispersity, but preferably exhibits a low level of dispersity. It is preferred that the starting tabular grain emulsion exhibit a coefficient of variation (COV) of grain diameter of less than 30 percent, most preferably less than 25 percent. Conventional starting tabular grain emulsions are known having a COV of less than 10 percent. Grain COV is herein defined as 100 times the standard deviation of grain ECD divided by mean grain ECD.

Conventional high chloride {111} tabular grain emulsions are illustrated by the following:

Wey et al U.S. Pat. No. 4,414,306;
Maskasky U.S. Pat. No. 4,400,463;
Maskasky U.S. Pat. No. 4,713,323;
Takada et al U.S. Pat. No. 4,783,398;
Nishikawa et al U.S. Pat. No. 4,952,491;
Ishiguro et al U.S. Pat. No. 4,983,508;
Tufano et al U.S. Pat. No. 4,804,621;
Houle et al U.S. Pat. No. 5,035,992;
Maskasky U.S. Pat. No. 5,061,617;
Maskasky U.S. Pat. No. 5,178,997;
Maskasky and Chang U.S. Pat. No. 5,178,998;
Maskasky U.S. Pat. No. 5,183,732;
Maskasky U.S. Pat. No. 5,185,239;
Maskasky U.S. Pat. No. 5,217,858;
Chang et al U.S. Pat. No. 5,252,452;
Maskasky U.S. Pat. No. 5,298,387 and
Maskasky U.S. Pat. No. 5,298,388.

Conventional high bromide {111} tabular grain emulsions are illustrated by the following:

Abbott et al U.S. Pat. No. 4,425,425;
Abbott et al U.S. Pat. No. 4,425,426;
Wilgus et al U.S. Pat. No. 4,434,226;
Kofron et al U.S. Pat. No. 4,439,520;
Daubendiek et al U.S. Pat. No. 4,414,310;
Solberg et al U.S. Pat. No. 4,433,048;
Yamada et al U.S. Pat. No. 4,647,528;
Sugimoto et al U.S. Pat. No. 4,665,012;
Daubendiek et al U.S. Pat. No. 4,672,027;
Yamada et al U.S. Pat. No. 4,678,745;
Maskasky U.S. Pat. No. 4,684,607;
Yagi et al U.S. Pat. No. 4,686,176;
Hayashi U.S. Pat. No. 4,783,398;
Daubendiek et al U.S. Pat. No. 4,693,964;
Maskasky U.S. Pat. No. 4,713,320;
Nottorf U.S. Pat. No. 4,722,886;
Sugimoto U.S. Pat. No. 4,755,456;
Goda U.S. Pat. No. 4,775,617;
Saitou et al U.S. Pat. No. 4,797,354;
Ellis U.S. Pat. No. 4,801,522;
Ikeda et al U.S. Pat. No. 4,806,461;
Ohashi et al U.S. Pat. No. 4,835,095;
Makino et al U.S. Pat. No. 4,835,322;
Bando U.S. Pat. No. 4,839,268;
Daubendiek et al U.S. Pat. No. 4,914,014;
Aida et al U.S. Pat. No. 4,962,015;
Saitou et al U.S. Pat. No. 4,977,074;
Ikeda et al U.S. Pat. No. 4,985,350;
Piggin et al U.S. Pat. No. 5,061,609;
Piggin et al U.S. Pat. No. 5,061,616;
Takehara et al U.S. Pat. No. 5,068,173;
Nakemura et al U.S. Pat. No. 5,096,806;
Bell et al U.S. Pat. No. 5,132,203;
Tsaur et al U.S. Pat. No. 5,147,771;
Tsaur et al U.S. Pat. No. 5,147,772;
Tsaur et al U.S. Pat. No. 5,147,773;

Tsaur et al U.S. Pat. No. 5,171,659;
Tsaur et al U.S. Pat. No. 5,210,013;
Antoniades et al U.S. Pat. No. 5,250,403;
Kim et al U.S. Pat. No. 5,272,048;
Sutton et al U.S. Pat. No. 5,334,469;
Black et al U.S. Pat. No. 5,334,495;
Chaffee et al U.S. Pat. No. 5,358,840;
Delton U.S. Pat. No. 5,372,927; and
Zola and Bryant EPO 0 362 699.

Emulsions containing {100} major face tabular grains are illustrated by the following:

Mignot U.S. Pat. No. 4,386,156;
Maskasky U.S. Pat. No. 5,275,930;
Maskasky U.S. Pat. No. 5,292,632;
Brust et al U.S. Pat. No. 5,314,798;
House et al U.S. Pat. No. 5,320,938;
Szajewski U.S. Pat. No. 5,310,635;
Szajewski et al U.S. Pat. No. 5,356,764;
Saitou et al EPO 0 569 971; and
Saito et al Jap. Patent Application 92/77261.

The addition of epitaxial phases to the starting tabular grains has little, if any, impact on the mean ECD, COV, or percent of total grain projected area accounted for by tabular grains in the emulsions of the invention. Hence the values indicated above for these parameters in the starting tabular grain emulsions apply also to the completed emulsions according to the invention.

The first epitaxial phase deposited on the starting tabular grains (the host tabular grain portions of the resulting composite grains) contains at least 90, preferably at least 95, mole percent iodide. The remaining halide can be bromide and/or chloride. The inclusion of minor amounts of halides other than iodide is typically the result of undertaking precipitation of the epitaxial phase by silver and iodide ion introduction into the starting tabular grain emulsion in the presence of bromide and/or chloride ions in the dispersing medium of the starting tabular grain emulsion that are in equilibrium with the tabular grains. Bromide and/or chloride ion inclusion can be limited by limiting their availability and is in all instances limited by the inability of the bromide and/or chloride ions to incorporate into the crystal lattice structure of the epitaxial phase, which is not an FCCRS crystal lattice structure, in concentrations of greater than 10 mole percent.

Silver iodide under conditions relevant to emulsion precipitation is generally reported to form either a hexagonal wurtzite (β phase) or face centered cubic zinc blende type (γ phase) silver iodide phase. Depending upon the specific precipitation conditions selected it is believed that the first epitaxial phase can be any one or a combination of these phases.

The first epitaxial phase preferably accounts for less than 25, more preferably less than 20 and, in most instances, less than 10, percent of the total silver forming the composite grains. The minimum amount of silver contained in the first epitaxial phase is determined by the requirement that this phase be located on at least 25 percent of the major faces of the host tabular grains. Fortunately, it has been discovered that the first epitaxial phase can be deposited on the major faces in the form of thin plates, preferably having thicknesses in the range of from 50 nm (0.05 μm) to 1 nm (0.001 μm). Thus, very small amounts of silver in the first epitaxial phase are capable of occupying a large percentage of the major faces of the host tabular grains.

As the thickness of the host tabular grains decreases, it is appreciated that the percentage of total silver provided by the first epitaxial phase increases, even when the thickness of the plates and the percentage of the total surface they occupy remains the unchanged. Thus, with ultrathin (<0.07 mean ECD) host tabular grains, it is contemplated that nearly 60 percent of the total silver forming the composite grains can be provided by first epitaxial phase. However, even using ultrathin host tabular grain emulsions, it is preferred to limit the first epitaxial phase to less than 50 percent of total silver forming the composite grains.

Exactly how thick the plates of the first epitaxial phase should be and what percentage of total major face coverage should be sought for optimum performance depends upon the function that the first epitaxial phase is required to perform. If an emulsion of the invention is intended to be employed primarily for absorbing short blue light on exposure, short blue light absorption increases as the thickness of the plates is increased and as the percentage of the major faces of the host tabular grains occupied is increased. At 427 nm, the absorption maxima of silver iodide, the portion of a silver iodide epitaxial phase on the upper major faces of the host tabular grains is capable of absorbing 63 percent of the photons it receives when the epitaxial phase thickness is 50 nm, and 86 percent of the photons passing through the silver iodide epitaxial phase located on both major faces of the host tabular grains are absorbed. These short blue absorptions are so much higher than those of the silver iodobromides and blue spectral sensitizing dyes conventionally used for short blue absorption, it is apparent that the plates can be much thinner than 50 nm and still offer advantageous short blue light absorption. Further, it must be kept in mind that at conventional silver coating coverages of silver halide emulsions several tabular grains are positioned to intercept a photon received at any one point. To distribute short blue light absorption within the grain population and thereby use the grains to maximum advantage it is preferred to decrease the thickness of the plates to less than 25 nm, most preferably less than 10 nm, while increasing the percentage of the host tabular grain major surfaces they overlie. It is preferred that the plates occupy at least 50, most preferably at least 70, percent of the major faces of the host tabular grains.

It should be specifically noted that the probability of a short blue photon being transmitted through an emulsion layer containing grains according to the invention can be reduced to such a low level that the common problem of blue punch through can be virtually non-existent. Stated another way, short blue light penetrating the emulsion layer can be reduced to such low levels that common protective approaches, such as yellow (blue absorbing) filter layers to protect underlying minus blue recording layers from blue light exposure can be omitted without incurring any significant imaging penalty.

If, instead of short blue absorption, the emulsions of the invention are employed in combination with a minus blue spectral sensitizing dye with the function of the high iodide silver halide epitaxial phase being limited to providing a surface trap for photoholes, then both the thickness and the percentage of major face coverage of the plates can be reduced. Only a minimal thickness is required for a plate to function as a hole trap. At the same time, if the plate is not located to intercept a photon, it can still act as a hole trap, since lateral migration of holes and electrons within the FCCRS crystal lateral structure is more than adequate to allow this to occur. However, for maximum imaging efficiency it is still preferred that the plates occupy at least 25 percent of the major faces of the host tabular grains.

For the composite grains to maintain high levels of imaging efficiency it is essential that the high iodide silver halide epitaxial phase be restricted to only a portion of the host tabular grain exterior surfaces. In the absence of further composite grain modifications to place latent image, described below, latent image sites are formed in the host tabular grains. By contrast, development of a conventional core-shell grain containing a high iodide silver halide shell requires that development begin at a high iodide surface of the grain, thereby releasing relatively high levels of iodide ion to solution that can slow or arrest the rate of subsequent development.

In preferred forms of the invention described below modified for directing latent image formation to a specific grain site, as much as 99 percent of the exterior of the host tabular grains can be covered by the high iodide silver halide epitaxy. It is preferred that the high iodide silver halide epitaxy cover no more than 90 percent of the exterior of the host tabular grains.

Since, in the absence of the high iodide silver halide epitaxy, the edges of the host tabular grains are the favored locations for latent image formation, it is preferred to leave as much of the peripheral edge of the host tabular grains free of the high iodide silver halide epitaxy as possible. For example, where only a small fraction of the total exterior of the host tabular grains is free of the high iodide silver halide epitaxy, it is preferred that the largest possible portion of this small fraction be located at the edges of the host tabular grains.

It has been discovered quite unexpectedly that depositing the high iodide silver halide epitaxy on the host tabular grains as plates is easily accomplished only when the high iodide silver halide phase is precipitated by controlled double jet precipitation. Attempts to grow silver iodide plates over the major surfaces of host tabular grains by ripening out silver iodide Lippmann grains have not been entirely successful, often resulting in large plates that extend outwardly beyond the periphery of the host tabular grains.

For successful high iodide plate formation on the major faces of the host tabular grains it has been discovered that both the iodide and bromide ion concentrations in the dispersing medium surrounding the grains must be controlled during formation of the high iodide first epitaxial phase. To appreciate the parameters involved it is first necessary to recognize that silver halide (AgX, where X represents any photographically useful halide) exists in a photographic emulsion in equilibrium with its component ions. This is illustrated as follows:

$$Ag^+ + X^- \rightleftharpoons AgX \quad \text{(I)}$$

While at equilibrium almost all of the silver and halide ions are present in the AgX crystal structure, a low level of $Ag^+$ and $X^-$ remain in solution. At any given temperature the activity product of $Ag^+$ and $X^-$ is, at equilibrium, a constant and satisfies the relationship:

$$K_{sp}=[Ag^+][X^-] \quad \text{(II)}$$

where $[Ag^+]$ represents the equilibrium silver ion activity, $[X^-]$ represents the equilibrium halide ion activity, and $K_{sp}$ is the solubility product constant of the silver halide.

To avoid working with small fractions, the following relationship is also widely employed:

$$-\log K_{sp}=pAg+pX \quad \text{(III)}$$

where pAg represents the negative logarithm of the equilibrium silver ion activity and pX represents the negative logarithm of the equilibrium halide ion activity.

The solubility product constants of the photographic silver halides are well known. The solubility product constants of AgCl, AgBr and AgI over the temperature range of from 0° to 100° C. are published in Mees and James, *The Theory of the Photographic Process*, 3rd Ed., Macmillan, 1966, at page 6. Specific values are provided in Table I.

TABLE I

| Temperature °C. | AgCl $-\log K_{sp}$ | AgI $-\log K_{sp}$ | AgBr $-\log K_{sp}$ |
|---|---|---|---|
| 40 | 9.2 | 15.2 | 11.6 |
| 50 | 8.9 | 14.6 | 11.2 |
| 60 | 8.6 | 14.1 | 10.8 |
| 70 | 8.3 | — | 10.5 |
| 80 | 8.1 | 13.2 | 10.1 |
| 90 | 7.6 | — | 9.8 |

In preparing photographic emulsions the relative amounts of $Ag^+$ are maintained less than those of $X^-$ to avoid fogging the emulsion. The relationship in which the concentrations of $Ag^+$ and $X^-$ in solution are equal is referred to as the equivalence point. The equivalence point is the pX of the most soluble halide present that is exactly half the $-\log K_{sp}$ of the corresponding silver halide.

To minimize the risk of halide conversion occurring in the host tabular grains during precipitation of the high iodide plates it is contemplated to limit the concentration of iodide ion in the dispersing medium during precipitation to a pI of greater than 4.0. Lower levels of iodide in solution ranging to a pI of 9.5 are contemplated. A preferred pI range of is from about 4.5 to 9.0.

To maximize major face deposition of the high iodide epitaxy and minimize peripheral edge deposition it is preferred that the concentration of the remaining halide ion in solution (i.e., bromide or chloride) be maintained between a concentration of minimum solubility and the equivalence point. For example, for a high bromide host tabular grain emulsion (e.g., a silver bromide or iodobromide tabular grain emulsion), it is preferred to maintain the pBr of the dispersing medium in the range of from 3.3 and 5.4 at 60° C. The equivalence point of silver chloride at 60° C. occurs at a pCl 4.3 and its minimum solubility occurs at a pCl of 2.4.

Normally high bromide and high chloride tabular grain emulsions are precipitated with a large halide ion excess. The halide ion concentration in solution is well above its minimum solubility concentration. Silver bromide tabular grains are typically precipitated at pBr values below 3.0, while silver chloride tabular grains are typically precipitated at pCl values of less than 2.4. Thus adjustment of the remaining halide ion concentrations in solution, in addition to introducing concurrently iodide and silver ions, is contemplated for deposition of the high iodide epitaxy preferentially onto the major faces of the host tabular grains.

Figure 7:
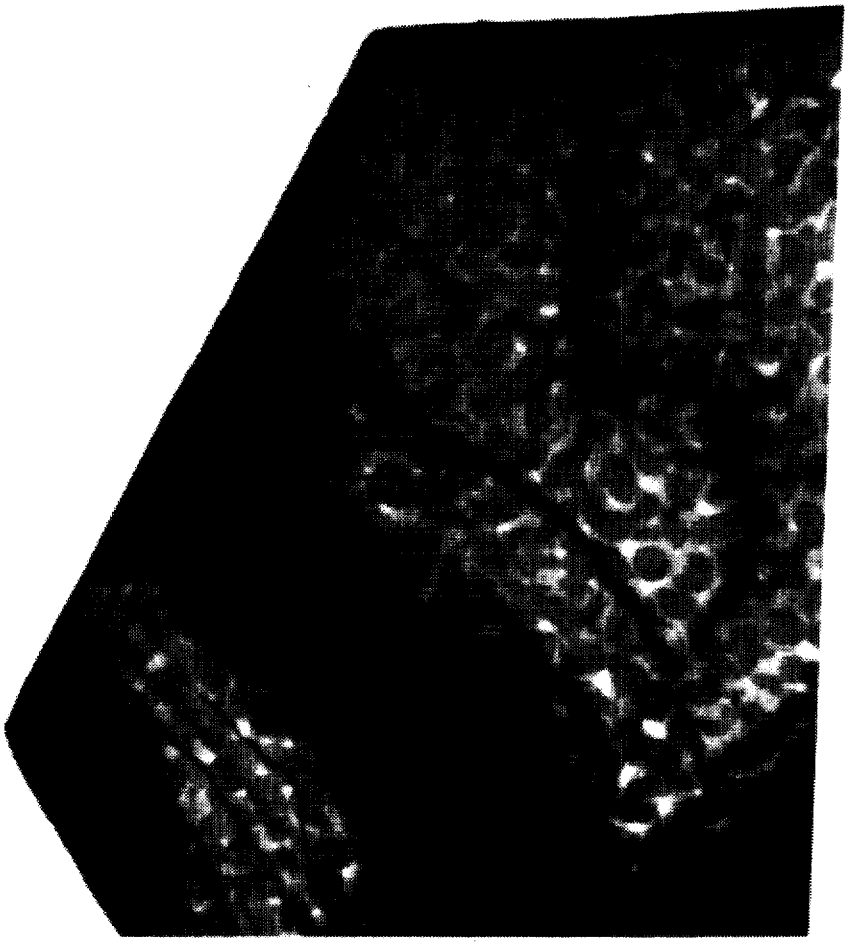
FIGS. 7 and 8 are transmission electron micrographs of the face and edges, respectively, of tabular grains from another emulsion according to the invention.

In FIGS. 1 and 2 the high iodide epitaxy is shown as discrete triangular or hexagonal plates. In fact, under the conditions that most favor major face deposition, the high iodide epitaxy loses its linear boundaries, with adjacent plates often merging, as shown in FIG. 7.

A preferred sensitization for the emulsions of the invention is to effect a second epitaxial deposition onto the composite tabular grains after the first epitaxial phase has been precipitated. The epitaxial phase can be formed by the epitaxial precipitation of one or more silver salts on a host grain of a differing composition at selected surface sites, as illustrated by Maskasky U.S. Pat. Nos. 4,094,684, 4,435,501, 4,463,087, 4,471,050 and 5,275,930, Ogawa U.S. Pat. No. 4,735,894, Yamashita et al U.S. Pat. No. 5,011,767, Haugh et al U.K. Patent 2,038,792, Koitabashi EPO 0 019 917, Ohya et al EPO 0 323 215, Takada EPO 0 434 012, Chen EPO 0 498 302 and Berry and Skillman, "Surface Structures and Epitaxial Growths on AgBr Microcrystals", *Journal of Applied Physics*, Vol. 35, No. 7, July 1964, pp. 2165–2169.

The preferred epitaxial sensitization of emulsions according to the invention containing high bromide host tabular grains is to deposit epitaxially silver chloride at the edges or, preferably, the corners of the tabular grains. Minor amounts, preferably less than 10 mole percent, based on total silver forming the second epitaxial phase) of silver bromide and iodide are incorporated into the epitaxy in addition to silver chloride. Although the silver chloride epitaxy can to some extent overlap adjacent high iodide plates, the high iodide plates tend to direct epitaxy to the host grain exterior surfaces. Hence, epitaxial junctions are formed between the second epitaxial phase at the exterior surfaces of the host tabular grains. When the host tabular grains are high chloride tabular grains, the second epitaxial phase is preferably a high bromide silver halide composition, such as silver bromide, optionally containing minor amounts of chloride and/or iodide, typically limited to 10 mole percent or less of the second epitaxial phase. Conventional chemical sensitization, such as sulfur and/or gold sensitization can, if desired, by combined with sensitization provided by the second epitaxial phase.

The second epitaxial phase when present preferably accounts for less than 25 (most preferably less than 10) percent of the total silver forming the composite grains. The second epitaxial phase is effective, even when it accounts for as little as 1 mole percent of total silver. Preferably the second epitaxial phase accounts for at least 2, optimally at least 5, percent of the total silver forming the composite grains.

When the host tabular grains have {111} major faces, a preferred technique for directing the second epitaxial phase to the edges and/or corners of the tabular grains is to employ a J aggregating spectral sensitizing dye as a site director, as taught by Maskasky U.S. Pat. No. 4,435,501. Maskasky '501 further teaches that surface iodide is capable of acting as a site director. Thus, the iodide in the first epitaxial phase assists in directing the second epitaxial phase to the edges and corners of the host tabular grains. When the host tabular grains have {100} major faces, adsorbed site directors are not required to deposit the second epitaxial phase at the corners of the host tabular grains, but can be employed, if desired.

It is specifically contemplated to incorporate one or more dopants in the crystal lattice structure of either the host tabular grains or the second epitaxial phase, both of which exhibit an FCCRS crystal lattice structure. When two or more dopants are incorporated, it is specifically contemplated to place one dopant in the host tabular grain and another in the second epitaxial phase to avoid antagonistic effects that can occur when dissimilar dopants are present in the same grain region. Any conventional dopant known to be useful in an FCCRS crystal lattice can be incorporated. Photographically useful dopants selected from a wide range of periods and groups within the Periodic Table of Elements have been reported. Conventional dopants include ions from periods 3 to 7 (most commonly 4 to 6) of the Periodic Table of Elements, such as Fe, Co, Ni, Ru, Rh, Pd, Re, Os, Ir, Pt, Mg, Al, Ca, Sc, Ti, V, Cr, Fin, Cu, Zn, Ga, Ge, As, Se, Sr, Y, Mo, Zr, Nb, Cd, In, Sn, Sb, Ba, La, W, Au, Hg, Tl, Pb, Bi, Ce and U. The dopants can be employed (a) to increase the sensitivity, (b) to reduce high or low intensity reciprocity failure, (c) to increase, decrease or reduce the variation of contrast, (d) to reduce pressure sensitivity, (e) to decrease dye desensitization, (f) to increase stability (including reducing thermal instability), (g) to reduce minimum density, and/or (h) to increase maximum density. For some uses any polyvalent metal ion is effective. The following are illustrative of conventional dopants capable of producing one or more of the effects noted above when incorporated in the silver halide epitaxy: B. H. Carroll, "Iridium Sensitization: A Literature Review", *Photographic Science and Engineering*, Vol. 24, No. 6, Nov./Dec. 1980, pp. 265–267; Hochstetter U.S. Pat. No. 1,951,933; De Witt U.S. Pat. No. 2,628,167; Spence et al U.S. Pat. No. 3,687,676 and Gilman et al U.S. Pat. No. 3,761,267; Ohkubo et al U.S. Pat. No. 3,890,154; Iwaosa et al U.S. Pat. No. 3,901,711; Yamasue et al U.S. Pat. No. 3,901,713; Habu et al U.S. Pat. No. 4,173,483; Atwell U.S. Pat. No. 4,269,927; Weyde U.S. Pat. No. 4,413,055; Menjo et al U.S. Pat. No. 4,477,561; Habu et al U.S. Pat. No. 4,581,327; Kobuta et al U.S. Pat. No. 4,643,965; Yamashita et al U.S. Pat. No. 4,806,462; Grzeskowiak et al U.S. Pat. No. 4,828,962; Janusonis U.S. Pat. U.S. Pat. No. 4,835,093; Leubner et al U.S. Pat. No. 4,902,611; Inoue et al U.S. Pat. No. 4,981,780; Kim U.S. Pat. No. 4,997,751; Shiba et al U.S. Pat. No. 5,057,402; Maekawa et al U.S. Pat. No. 5,134,060; Kawai et al U.S. Pat. No. 5,153,110; Johnson et al U.S. Pat. No. 5,164,292; Asami U.S. Pat. Nos. 5,166,044 and 5,204,234; Wu U.S. Pat. No. 5,166,045; Yoshida et al U.S. Pat. No. 5,229,263; Bell U.S. Pat. Nos. 5,252,451 and 5,252,530; Komorita et al EPO 0 244 184; Miyoshi et al EPO 0 488 737 and 0 488 601; Ihama et al EPO 0 368 304; Tashiro EPO 0 405 938; Murakami et al EPO 0 509 674 and 0 563 946 and Japanese Patent Application Hei-2[1990]-249588 and Budz WO 93/02390.

When dopant metals are present during precipitation in the form of coordination complexes, particularly tetra- and hexa-coordination complexes, both the metal ion and the coordination ligands can be occluded within the grains. Coordination ligands, such as halo, aquo, cyano, cyanate, fulminate, thiocyanate, selenocyanate, tellurocyanate, nitrosyl, thionitrosyl, azide, oxo, carbonyl and ethylenediamine tetraacetic acid (EDTA) ligands have been disclosed and, in some instances, observed to modify emulsion properties, as illustrated by Grzeskowiak U.S. Pat. No. 4,847,191, McDugle et al U.S. Pat. Nos. 4,933,272, 4,981,781 and 5,037,732, Marchetti et al U.S. Pat. No. 4,937,180, Keevert et al U.S. Pat. No. 4,945,035, Hayashi U.S. Pat. No. 5,112,732, Murakami et al EPO 0 509 674, Ohya et al EPO 0 513 738, Janusonis WO 91/10166, Beavers WO 92/16876, Pietsch et al German DD 298,320, Olm et al U.S. Pat. No. 5,360,712, and Kuromoto et al U.S. Pat. No. 5,462,849. Olm et al and Kuromoto et al, cited above, disclose hexacoordination complexes containing organic ligands while Bigelow U.S. Pat. No. 4,092,171 discloses organic ligands in Pt and Pd tetra-coordination complexes.

It is specifically contemplated to incorporate in the silver halide epitaxy a dopant to reduce reciprocity failure. Iridium is a preferred dopant for decreasing reciprocity failure. The teachings of Carroll, Iwaosa et al, Habu et al, Grzeskowiak et al, Kim, Maekawa et al, Johnson et al, Asami, Yoshida et al, Bell, Miyoshi et al, Tashiro and Murakami et al EPO 0 509 674, each cited above, are here incorporated by reference. These teachings can be applied to the emulsions of the invention merely by incorporating the dopant in the silver halide epitaxy.

In another specifically preferred form of the invention it is contemplated to incorporate in the face FCCRS crystal lattice structure of the host tabular grains or second epitaxial phase a dopant capable of increasing photographic speed by forming shallow electron traps, hereinafter also referred to as a SET dopant. When a photon is absorbed by a silver halide grain, an electron (hereinafter referred to as a photoelectron) is promoted from the valence band of the silver halide crystal lattice to its conduction band, creating a hole (hereinafter referred to as a photohole) in the valence band. To create a latent image site within the grain, a plurality of photoelectrons produced in a single imagewise exposure must reduce several silver ions in the crystal lattice to form a small cluster of $Ag^o$ atoms. To the extent that photoelectrons are dissipated by competing mechanisms before the latent image can form, the photographic sensitivity of the silver halide grains is reduced. For example, if the photoelectron returns to the photohole, its energy is dissipated without contributing to latent image formation.

It is contemplated to dope FCCRS crystal lattice to create within it shallow electron traps that contribute to utilizing photoelectrons for latent image formation with greater efficiency. This is achieved by incorporating in the face centered cubic crystal lattice a dopant that exhibits a net valence more positive than the net valence of the ion or ions it displaces in the crystal lattice. For example, in the simplest possible form the dopant can be a polyvalent (+2 to +5) metal ion that displaces silver ion ($Ag^+$) in the crystal lattice structure. The substitution of a divalent cation, for example, for the monovalent $Ag^+$ cation leaves the crystal lattice with a local net positive charge. This lowers the energy of the conduction band locally. The amount by which the local energy of the conduction band is lowered can be estimated by applying the effective mass approximation as described by J. F. Hamilton in the journal *Advances in Physics,* Vol. 37 (1988) p. 395 and *Excitonic Processes in Solids* by M. Ueta, H. Kansaki, K. Kobayshi, Y. Toyozawa and E. Hanamura (1986), published by Springer-Verlag, Berlin, p. 359. If a silver chloride crystal lattice structure receives a net positive charge of +1 by doping, the energy of its conduction band is lowered in the vicinity of the dopant by about 0.048 electron volts (eV). For a net positive charge of +2 the shift is about 0.192 eV. For a silver bromide crystal lattice structure a net positive charge of +1 imparted by doping lowers the conduction band energy locally by about 0.026 eV. For a net positive charge of +2 the energy is lowered by about 0.104 eV.

When photoelectrons are generated by the absorption of light, they are attracted by the net positive charge at the dopant site and temporarily held (i.e., bound or trapped) at the dopant site with a binding energy that is equal to the local decrease in the conduction band energy. The dopant that causes the localized bending of the conduction band to a lower energy is referred to as a shallow electron trap because the binding energy holding the photoelectron at the dopant site (trap) is insufficient to hold the electron permanently at the dopant site. Nevertheless, shallow electron trapping sites are useful. For example, a large burst of photoelectrons generated by a high intensity exposure can be held briefly in shallow electron traps to protect them against immediate dissipation while still allowing their efficient migration over a period of time to latent image forming sites.

For a dopant to be useful in forming a shallow electron trap it must satisfy additional criteria beyond simply providing a net valence more positive than the net valence of the ion or ions it displaces in the crystal lattice. When a dopant is incorporated into the silver halide crystal lattice, it creates in the vicinity of the dopant new electron energy levels (orbitals) in addition to those energy levels or orbitals which comprised the silver halide valence and conduction bands. For a dopant to be useful as a shallow electron trap it must satisfy these additional criteria: (1) its highest energy electron occupied molecular orbital (HOMO, also commonly referred to as the frontier orbital) must be filled—e.g., if the orbital will hold two electrons (the maximum possible number), it must contain two electrons and not one and (2) its lowest energy unoccupied molecular orbital (LUMO) must be at a higher energy level than the lowest energy level conduction band of the silver halide crystal lattice. If conditions (1) and/or (2) are not satisfied, there will be a local, dopant-derived orbital in the crystal lattice (either an unfilled HOMO or a LUMO) at a lower energy than the local, dopant-induced conduction band minimum energy, and photoelectrons will preferentially be held at this lower energy site and thus impede the efficient migration of photoelectrons to latent image forming sites.

Metal ions satisfying criteria (1) and (2) are the following: Group 2 metal ions with a valence of +2, Group 3 metal ions with a valence of +3 but excluding the rare earth elements 58–71, which do not satisfy criterion (1), Group 12 metal ions with a valence of +2 (but excluding Hg, which is a strong desensitizer, possibly because of spontaneous reversion to $Hg^{+1}$), Group 13 metal ions with a valence of +3, Group 14 metal ions with a valence of +2 or +4 and Group 15 metal ions with a valence of +3 or +5. Of the metal ions satisfying criteria (1) and (2) those preferred on the basis of practical convenience for incorporation as dopants include the following period 4, 5 and 6 elements: ianthanum, zinc, cadmium, gallium, indium, thallium, germanium, tin, lead and bismuth. Specifically preferred metal ion dopants satisfying criteria (1) and (2) for use in forming shallow electron traps are zinc, cadmium, indium, lead and bismuth. Specific examples of shallow electron trap dopants of these types are provided by DeWitt, Gilman et al, Atwell et al, Weyde et al and Murakima et al EPO 0 590 674 and 0 563 946, each cited above and here incorporated by reference.

Metal ions in Groups 8, 9 and 10 (hereinafter collectively referred to as Group VIII metal ions) that have their frontier orbitals filled, thereby satisfying criterion (1), have also been investigated. These are Group 8 metal ions with a valence of +2, Group 9 metal ions with a valence of +3 and Group 10 metal ions with a valence of +4. It has been observed that these metal ions are incapable of forming efficient shallow electron traps when incorporated as bare metal ion dopants. This is attributed to the LUMO lying at an energy level below the lowest energy level conduction band of the silver halide crystal lattice.

However, coordination complexes of these Group VIII metal ions as well as $Ga^{+3}$ and $In^{+3}$, when employed as dopants, can form efficient shallow electron traps. The requirement of the frontier orbital of the metal ion being filled satisfies criterion (1). For criterion (2) to be satisfied at least one of the ligands forming the coordination complex must be more strongly electron withdrawing than halide (i.e., more electron withdrawing than a fluoride ion, which is the most highly electron withdrawing halide ion).

One common way of assessing electron withdrawing characteristics is by reference to the spectrochemical series of ligands, derived from the absorption spectra of metal ion complexes in solution, referenced in *Inorganic Chemistry: Principles of Structure and Reactivity*, by James E. Huheey, 1972, Harper and Row, New York and in *Absorption Spectra and Chemical Bonding in Complexes* by C. K. Jorgensen, 1962, Pergamon Press, London. From these references the following order of metal ions in the spectrochemical series is apparent:

$$I^- < Br^- < S^{-2} < \underline{S}CN^- < Cl^- < NO_3^- < F^- < \underline{O}H$$

$$< ox^{-2} < H_2\underline{O} < \underline{N}CS^- < CH_3C\underline{N}^- < \underline{N}H_3 < en < dipy$$

$$< phen < \underline{N}O_2^- < phosph << \underline{C}N^- < \underline{C}O.$$

The abbreviations used are as follows: ox=oxalate, dipy=dipyridine, phen=o-phenathroline, and phosph =4-methyl-2,6,7-trioxa-1-phosphabicyclo[2.2.2]octane. The spectrochemical series places the ligands in sequence in their electron withdrawing properties, the first ($I^-$) ligand in the series is the least electron withdrawing and the last (CO) ligand being the most electron withdrawing. The underlining indicates the site of ligand bonding to the polyvalent metal ion. The efficiency of a ligand in raising the LUMO value of the dopant complex increases as the ligand atom bound to the metal changes from Cl to S to O to N to C. Thus, the ligands $CN^-$ and CO are especially preferred. Other preferred ligands are thiocyanate ($NCS^-$), selenocyanate ($NCSe^-$), cyanate ($NCO^-$), tellurocyanate ($NCTe^-$) and azide ($N_3^-$).

Just as the spectrochemical series can be applied to ligands of coordination complexes, it can also be applied to the metal ions. The following spectrochemical series of metal ions is reported in *Absorption Spectra and Chemical Bonding* by C. K. Jorgensen, 1962, Pergamon Press, London:

$$Mn^{+2} < Ni^{+2} < CO^{+2} < Fe^{+2} < Cr^{+3}$$

$$\approx V^{+3} < CO^{+3} < Mn^{+4} < Mo^{+3} < Rh^{+3}$$

$$\approx Ru^{+3} < Pd^{+4} < Ir^{+3} < Pt^{+4}$$

The metal ions in boldface type satisfy frontier orbital requirement (1) above. Although this listing does not contain all the metals ions which are specifically contemplated for use in coordination complexes as dopants, the position of the remaining metals in the spectrochemical series can be identified by noting that an ion's position in the series shifts from $Mn^{+2}$, the least electronegative metal, toward $Pt^{+4}$, the most electronegative metal, as the ion's place in the Periodic Table of Elements increases from period 4 to period 5 to period 6. The series position also shifts in the same direction when the positive charge increases. Thus, $Os^{+3}$, a period 6 ion, is more electronegative than $Pd^{+4}$, the most electronegative period 5 ion, but less electronegative than $Pt^{+4}$, the most electronegative period 6 ion.

From the discussion above $Rh^{+3}$, $Ru^{+3}$, $Pd^{+4}$, $Ir^{+3}$, $Os^{+3}$ and $Pt^{+4}$ are clearly the most electro-negative metal ions satisfying frontier orbital requirement (1) above and are therefore specifically preferred.

To satisfy the LUMO requirements of criterion (2) above the filled frontier orbital polyvalent metal ions of Group VIII are incorporated in a coordination complex containing ligands, at least one, most preferably at least 3, and optimally at least 4 of which are more electronegative than halide, with any remaining ligand or ligands being a halide ligand. When the metal ion is itself highly electronegative, such $Os^{+3}$, only a single strongly electronegative ligand, such as carbonyl, for example, is required to satisfy LUMO requirements. If the metal ion is itself of relatively low electronegativity, such as $Fe^{+2}$, choosing all of the ligands to be highly electronegative may be required to satisfy LUMO requirements. For example, $Fe(II)(CN)_6$ is a specifically preferred shallow electron trapping dopant. In fact, coordination complexes containing 6 cyano ligands in general represent a convenient, preferred class of shallow electron trapping dopants.

Since $Ga^{+3}$ and $In^{+3}$ are capable of satisfying HOMO and LUMO requirements as bare metal ions, when they are incorporated in coordination complexes they can contain ligands that range in electronegativity from halide ions to any of the more electronegative ligands useful with Group VIII metal ion coordination complexes.

For Group VIII metal ions and ligands of intermediate levels of electronegativity it can be readily determined whether a particular metal coordination complex contains the proper combination of metal and ligand electronegativity to satisfy LUMO requirements and hence act as a shallow electron trap. This can be done by employing electron paramagnetic resonance (EPR) spectroscopy. This analytical technique is widely used as an analytical method and is described in *Electron Spin Resonance: A Comprehensive Treatise on Experimental Techniques*, 2nd Ed., by Charles P. Poole, Jr. (1983) published by John Wiley & Sons, Inc., New York.

Photoelectrons in shallow electron traps give rise to an EPR signal very similar to that observed for photoelectrons in the conduction band energy levels of the silver halide crystal lattice. EPR signals from either shallow trapped electrons or conduction band electrons are referred to as electron EPR signals. Electron EPR signals are commonly characterized by a parameter called the g factor. The method for calculating the g factor of an EPR signal is given by C. P. Poole, cited above. The g factor of the electron EPR signal in the silver halide crystal lattice depends on the type of halide ion(s) in the vicinity of the electron. Thus, as reported by R. S. Eachus, M. T. Olm, R. Janes and M. C. R. Symons in the journal *Physica Status Solidi (b)*, Vol. 152 (1989), pp. 583–592, in a AgCl crystal the g factor of the electron EPR signal is 1.88±0.001 and in AgBr it is 1.49±0.02.

A coordination complex dopant can be identified as useful in forming shallow electron traps in the practice of the invention if, in the test emulsion set out below, it enhances the magnitude of the electron EPR signal by at least 20 percent compared to the corresponding undoped control emulsion. The undoped control emulsion is a 0.45±0.05 μm edge length AgBr octahedral emulsion precipitated, but not subsequently sensitized, as described for Control 1A of Marchetti et al U.S. Pat. No. 4,937,180. The test emulsion is identically prepared, except that the metal coordination complex in the concentration intended to be used in the emulsion of the invention is substituted for $Os(CN_6)^{4-}$ in Example 1B of Marchetti et al.

After precipitation, the test and control emulsions are each prepared for electron EPR signal measurement by first centrifuging the liquid emulsion, removing the supernatant, replacing the supernatant with an equivalent amount of warm distilled water and resuspending the emulsion. This procedure is repeated three times, and, after the final centrifuge step, the resulting powder is air dried. These procedures are performed under safe light conditions.

The EPR test is run by cooling three different samples of each emulsion to 20°, 40° and 60° K., respectively, exposing each sample to the filtered output of a 200 W Hg lamp at a wavelength of 365 nm, and measuring the EPR electron signal during exposure. If, at any of the selected observation temperatures, the intensity of the electron EPR signal is significantly enhanced (i.e., measurably increased above signal noise) in the doped test emulsion sample relative to the undoped control emulsion, the dopant is a shallow electron trap.

As a specific example of a test conducted as described above, when a commonly used shallow electron trapping dopant, $Fe(CN)_6^{4-}$, was added during precipitation at a molar concentration of $50\times10^{-6}$ dopant per silver mole as described above, the electron EPR signal intensity was enhanced by a factor of 8 over undoped control emulsion when examined at 20° K.

Hexacoordination complexes are preferred coordination complexes for use in the practice of this invention. They contain a metal ion and six ligands that displace a silver ion and six adjacent halide ions in the crystal lattice. One or two of the coordination sites can be occupied by neutral ligands, such as carbonyl, aquo or ammine ligands, but the remainder of the ligands must be anionic to facilitate efficient incorporation of the coordination complex in the crystal lattice structure. Illustrations of specifically contemplated hexacoordination complexes for inclusion in the protrusions are provided by McDugle et al U.S. Pat. No. 5,037,732, Marchetti et al U.S. Pat. Nos. 4,937,180, 5,264,336 and 5,268,264, Keevert et al U.S. Pat. No. 4,945,035 and Murakami et al Japanese Patent Application Hei-2[1990]-249588, the disclosures of which are here incorporated by reference. Useful neutral and anionic organic ligands for hexacoordination complexes are disclosed by Olm et al U.S. Pat. No. 5,360,712. Careful scientific investigations have revealed Group VIII hexahalo coordination complexes to create deep (desensitizing) electron traps, as illustrated R. S. Eachus, R. E. Graves and M. T. Olm *J. Chem. Phys.*, Vol. 69, pp. 4580–7 (1978) and *Physica Status Solidi A*, vol. 57, 429–37 (1980).

In a specific, preferred form it is contemplated to employ as a dopant a hexacoordination complex satisfying the formula:

$$[ML_6]^n \qquad \text{(IV)}$$

where

M is filled frontier orbital polyvalent metal ion, preferably $Fe^{+2}$, $Ru^{+2}$, $Os^{+2}$, $Co^{+3}$, $Rh^{+3}$, $Ir^{+3}$, $Pd^{+4}$ or $Pt^{+4}$;

$L_6$ represents six coordination complex ligands which can be independently selected, provided that least four of the ligands are anionic ligands and at least one (preferably at least 3 and optimally at least 4) of the ligands is more electronegative than any halide ligand; and n is −2, −3 or −4.

The following are specific illustrations of dopants capable of providing shallow electron traps:

| | |
|---|---|
| SET-1 | $[Fe(CN)_6]^{-4}$ |
| SET-2 | $[Ru(CN)_6]^{-4}$ |
| SET-3 | $[Os(CN)_6]^{-4}$ |
| SET-4 | $[Rh(CN)_6]^{-3}$ |
| SET-5 | $[Ir(CN)_6]^{-3}$ |
| SET-6 | $[Fe(pyrazine)\ (CN)_5]^{-4}$ |
| SET-7 | $[RuCl(CN)_5]^{-4}$ |
| SET-8 | $[OsBr(CN)_5]^{-4}$ |
| SET-9 | $[RhF(CN)_5]^{-3}$ |
| SET-10 | $[IrBr(CN)_5]^{-3}$ |
| SET-11 | $[FeCO(CN)_5]^{-3}$ |
| SET-12 | $[RuF_2(CN)_4]^{-4}$ |
| SET-13 | $[OsCl_2(CN)_4]^{-4}$ |

-continued

| | |
|---|---|
| SET-14 | $[RhI_2(CN)_4]^{-3}$ |
| SET-15 | $[IrBr_2(CN)_4]^{-3}$ |
| SET-16 | $[Ru(CN)_5(OCN)]^{-4}$ |
| SET-17 | $[Ru(CN)_5(N_3)]^{-4}$ |
| SET-18 | $[Os(CN)_5(SCN)]^{-4}$ |
| SET-19 | $[Rh(CN)_5(SeCN)]^{-3}$ |
| SET-20 | $[Ir(CN)_5(HOH)]^{-2}$ |
| SET-21 | $[Fe(CN)_3Cl_3]^{-3}$ |
| SET-22 | $[Ru(CO)_2(CN)_4]^{-1}$ |
| SET-23 | $[Os(CN)Cl_5]^{-4}$ |
| SET-24 | $[Co(CN)_6]^{-3}$ |
| SET-25 | $[IrCl_4(oxalate)]^{-4}$ |
| SET-26 | $[In(NCS)_6]^{-3}$ |
| SET-27 | $[Ga(NCS)_6]^{-3}$ |

It is additionally contemplated to employ oligomeric coordination complexes to increase speed, as taught by Evans et al U.S. Pat. No. 5,024,931, the disclosure of which is here incorporated by reference.

The SET dopants are effective in conventional concentrations, where concentrations are based on the total silver in both the silver in the tabular grains and the silver in the second epitaxial phase. Generally shallow electron trap forming dopants are contemplated to be incorporated in concentrations of at least $1\times10^{-7}$ mole per silver mole up to their solubility limit, typically up to about $5\times10^{-4}$ mole per silver mole. Preferred concentrations are in the range of from about $10^{-5}$ to $10^{-4}$ mole per silver mole.

The contrast of the photographic emulsions of the invention can be further increased by doping the host grains with a hexacoordination complex containing a nitrosyl or thionitrosyl ligand. Preferred coordination complexes of this type are represented by the formula:

$$[TE_4(NZ)E']^r \qquad \text{(V)}$$

where

T is a transition metal;

E is a bridging ligand;

E' is E or NZ;

r is zero, −1, −2 or −3; and

Z is oxygen or sulfur.

The E ligands are typically halide, but can take any of the forms found in the SET dopants discussed above. A listing of suitable coordination complexes satisfying formula V is found in McDugle et al U.S. Pat. No. 4,933,272, the disclosure of which is here incorporated by reference.

The contrast increasing dopants (hereinafter also referred to as NZ dopants) can be incorporated in the host tabular grain structure at any convenient location. However, if the NZ dopant is present at the surface of the grain, it can reduce the sensitivity of the grains. It is therefore preferred that the NZ dopants be located in the host grains so that they are separated from the grain surface by at least 1 percent (most preferably at least 3 percent) of the total silver precipitated in forming the silver iodochloride grains. Preferred contrast enhancing concentrations of the NZ dopants range from $1\times10^{-11}$ to $4\times10^{-8}$ mole per silver mole, with specifically preferred concentrations being in the range from $10^{-10}$ to $10^{-8}$ mole per silver mole, based on silver in the host grains. It is also possible to locate an NZ dopant in the second epitaxial phase, but this is not a preferred location for this dopant.

The chemical sensitization of the emulsions of the invention can take any convenient conventional form. Conventional chemical sensitizations are summarized in *Research Disclosure*, Vol. 365, September 1994, Item 36544, IV. Chemical sensitization. The chemical sensitizers interact with the exposed surfaces of the host tabular grains and the second epitaxial phase to increase photographic sensitivity. Reduction sensitizers, middle chalcogen (e.g., sulfur) sensitizers, and noble metal (e.g., gold) sensitizers, employed singly or in combination are specifically contemplated.

The emulsions of the invention can be reduction sensitized in any convenient conventional manner. Conventional reduction sensitizations are summarized in *Research Disclosure*, Item 36544, cited above, IV. Chemical sensitization, paragraph (1). A specifically preferred class of reduction sensitizers are the 2-[N-(2-alkynyl)amino]-meta-chalcazoles disclosed by Lok et al U.S. Pat. Nos. 4,378,426 and 4,451,557, the disclosures of which are here incorporated by reference.

Preferred 2-[N-(2-alkynyl)amino]-meta-chalcazoles can be represented by the formula:

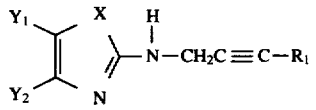

(VI)

where

X=O, S, Se;

$R_1$=(VIa) hydrogen or (VIb) alkyl or substituted alkyl or aryl or substituted aryl; and $Y_1$ and $Y_2$ individually represent hydrogen, alkyl groups or an aromatic nucleus or together represent the atoms necessary to complete an aromatic or alicyclic ring containing atoms selected from among carbon, oxygen, selenium, and nitrogen atoms.

As disclosed by Eikenberry et al, cited above, the formula (V) compounds are generally effective (with the (Vb) form giving very large speed gains and exceptional latent image stability) when present during the heating step (finish) that results in chemical sensitization.

In a preferred form of the invention, an alkynylamino substituent is attached to a benzoxazole, benzothiazole or benzoselenazole nucleus. In one specific preferred form, the compounds VIa of the present invention and companion non-invention compounds VIb can be represented by the following formula:

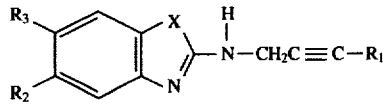

(VII)

where

VIIa—$R_1$=H

VIIa1—$R_1$=H, $R_2$=H, X=O

VIIa2—$R_1$=H, $R_2$=Me, X=O

VIIa3—$R_1$=H, $R_2$=H, X=S

VIIb—$R_1$=alkyl or aryl

VIIb1—$R_1$=Me, $R_2$=H, X=O $R_3$=H

VIIb2—$R_1$=Me, $R_2$=Me, X=O $R_3$=H

VIIb3—$R_1$=Me, $R_2$=H, X=S $R_3$=H

VIIb4—$R_1$=Ph, $R_2$=H, X=O $R_3$=H

Other preferred VIb structures have $R_1$ as ethyl, propyl, p-methoxyphenyl, p-tolyl, or p-chlorophenyl with $R_2$ or $R_3$ as halogen, methoxy, alkyl or aryl.

Whereas previous work employing compounds with structure similar to VIa and VIb described speed gains of about 40% using 0.10 mmole/silver mole when added after sensitization and prior to forming the layer containing the emulsion (Lok et al U.S. Pat. No. 4,451,557), speed gains have been demonstrated by Eikenberry et al ranging from 66% to over 250%, depending on the emulsion and sensitizing dye utilized, by adding 0.02–0.03 mmole/silver mole of VIb during the sensitization step. Significantly higher levels of fog are observed when the VIa compounds are employed.

The VIb compounds of the present invention typically contains an $R_1$ that is an alkyl or aryl. It is preferred that the $R_1$ be either a methyl or a phenyl ring for the best increase in speed and latent image keeping.

The compounds of the invention are added to the silver halide emulsion at a point subsequent to precipitation to be present during the finish step of the chemical sensitization process. A preferred concentration range for [N-(2-alkynyl)-amino]-meta-chalcazole incorporation in the emulsion is in the range of from 0.002 to 0.2 (most preferably 0.005 to 0.1) mmole per mole of silver. In a specifically preferred form of the invention [N-(2-alkynyl)amino]-meta-chalcazole reduction sensitization is combined with conventional gold (or platinum metal) and/or middle (S, Se or Te) chalcogen sensitizations. These sensitizations are summarized in *Research Disclosure* Item 36544, previously cited, IV. Chemical sensitization. The combination of sulfur, gold and [N-(2-alkynyl)amino]-meta-chalcazole reduction sensitization is specifically preferred.

A specifically preferred class of middle chalcogen sensitizers are tetrasubstituted middle chalcogen ureas of the type disclosed by Herz et al U.S. Pat. Nos. 4,749,646 and 4,810,626, the disclosures of which are here incorporated by reference. Preferred compounds include those represented by the formula:

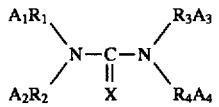

(VIII)

wherein

X is sulfur, selenium or tellurium;

each of $R_1$, $R_2$, $R_3$ and $R_4$ can independently represent an alkylene, cycloalkylene, alkarylene, aralkylene or heterocyclic arylene group or, taken together with the nitrogen atom to which they are attached, $R_1$ and $R_2$ or $R_3$ and $R_4$ complete a 5 to 7 member heterocyclic ring; and each of $A_1$, $A_2$, $A_3$ and $A_4$ can independently represent hydrogen or a radical comprising an acidic group, with the proviso that at least one $A_1R_1$ to $A_4R_4$ contains an acidic group bonded to the urea nitrogen through a carbon chain containing from 1 to 6 carbon atoms.

X is preferably sulfur and $A_1R_1$ to $A_4R_4$ are preferably methyl or carboxymethyl, where the carboxy group can be in the acid or salt form.

A specifically preferred tetrasubstituted thiourea sensitizer is 1,3-dicarboxymethyl-1,3-dimethylthiourea.

Specifically preferred gold sensitizers are the gold (I) compounds disclosed by Deaton U.S. Pat. No. 5,049,485, the disclosure of which is here incorporated by reference. These compounds include those represented by the formula:

$$AuL_2^+X^- \text{ or } AuL(L^1)^+X^- \quad \text{(IX)}$$

wherein

L is a mesoionic compound;

X is an anion; and $L^1$ is a Lewis acid donor.

As previously disclosed, in preferred photographic applications the tabular grain emulsions of the invention are spectrally sensitized. One of the significant advantages of the invention is that the presence of a high iodide first epitaxial phase on the major faces of the tabular grains can improve the adsorption of the spectral sensitizing dye or dyes employed and, particularly when the oxidation potential of the dye is more negative than the threshold value stated above, increase the efficiency with which photon energy is transferred between the spectral sensitizing dye and the grains.

Any conventional spectral sensitizing dye or dye combination can be employed with the emulsions of the invention. Suitable spectral sensitizing dye selections are disclosed in *Research Disclosure*, Item 36544, cited above, Section V. Spectral sensitization and desensitization. Preferred spectral sensitizing dyes are polymethine dyes, including cyanine, merocyanine, complex cyanine and merocyanine (i.e., tri-, tetra- and polynuclear cyanine and merocyanine), oxonol, hemioxonol, styryl, merostyryl, streptocyanine, hemicyanine and arylidene dyes. Specifically preferred blue sensitizing dyes are those disclosed by Kofron et al U.S. Pat. No. 4,439,520. Preferred spectral sensitizing dyes also capable of acting as site directors for the second epitaxial phase are those disclosed by Maskasky U.S. Pat. No. 4,435,501 in Table I. As demonstrated in the Examples below spectral sensitizing dyes and, particularly, spectral sensitizing dye combinations having reduction potentials more negative than the threshold value stated above provide unexpectedly high levels of photographic efficiency. The supersensitizing dye combinations set out in *Research Disclosure* Item 36544, Section V, A. Sensitizing dyes, paragraphs (6) and (6a) are specifically contemplated.

The following are illustrations of specific spectral sensitizing dyes contemplated for use with the emulsions of the invention, together with their oxidation (Eox) and reduction (Ered) potentials in volts:

SS-1

Anhydro-3,3'-bis(3-sulfopropyl)naphtho[1,2-d]thiazolothiacyanine hydroxide, triethylammonium salt Eox=1.300 Ered=−1.359

SS-2

Anhydro-3,3'-bis(3-sulfopropyl)-4'-phenylnaphtho[1,2-d] thiazolothiazolinocyanine hydroxide, sodium salt Eox=1.085 Ered=−1.758

SS-3

Anhydro-5'-chloro-3,3'-bis(3-sulfopropyl)naphtho[1,2-d] oxazolothiacyanine hydroxide, triethylammonium salt Eox= 1.375 Ered=−1.437

SS-4

Anhydro-3,3'-bis(3-sulfopropyl)-4,5,4',5'-dibenzothiacyanine hydroxide, sodium salt Eox=1.213 Ered=−1.371

SS-5

Anhydro-3,3'-bis(3-sulfopropyl)-5,6-dimethoxy-4'-phenylthiacyanine hydroxide, sodium salt Eox=1.240 Ered=−1.401

SS-6

Anhydro-5-chloro-3'-ethyl-3-(4-sulfobutyl)thiacyanine, inner salt Eox=1.399 Ered=−1.269

SS-7

Anhydro-5,5'-dimethoxy-3,3'-bis(3-sulfopropyl)thiacyanine hydroxide, inner salt Eox=1.310 Ered=−1.361

SS-8

Anhydro-5-chloro-3,3'-bis(3-sulfopropyl)thiacyanine hydroxide, sodium salt Eox=1.418 Ered=−1.309

SS-9

Anhydro-5,5'-bis(methylthio)-3,3'-bis(3-sulfobutyl)thiacyanine hydroxide, triethylammonium salt Eox=1.367 Ered=−1.249

SS-10

Anhydro-5,6-dimethoxy-5'-phenyl-3,3'-bis(3-sulfopropyl)thiacyanine hydroxide, triethylammonium salt Eox=1.240 Ered=−1.417

SS-11

Anhydro-3'-(2-carboxy-2-sulfoethyl)-1-ethyl-5',6'-dimethoxynaphtho[1,2-d]thiazolothiocyanine hydroxide, potassium salt Eox=1.153 Ered=−1.462

SS-12

Anhydro-3,3'-bis (3-sulfopropyl)-5',6'-dimethoxy-5-phenyloxathiacarbocyanine hydroxide, sodium salt Eox=1.259 Ered=−1.593

SS-13

3'-Ethyl-3-methyl-6-nitrothiathiazolinocyanined iodide Eox=1.271 Ered=−1.774

SS-14

Anhydro-5'-chloro-5-phenyl-3,3'-bis(3-sulfopropyl)oxathiacyanine hydroxide, triethylammonium salt Eox=1.447 Ered=−1.580

SS-15

Anhydro-5'-fluoro-3,3'-bis(3-sulfopropyl)naphtho[1,2-d] thiazolothiacyanine hydroxide, triethylammonium salt Eox= 1.322 Ered=−1.318

SS-16

Anhydro-5-chloro-3,3'-bis(sulfopropyl)naphtho[1,2-d]thiazolothiacyanine hydroxide, triethylammonium salt Eox= 1.341 Ered=−1.273

SS-17

Anhydro-4',5'-benzo-3,3'-bis(3-sulfopropyl)-5-pyrroloxathiacyanine hydroxide, triethylammonium salt Eox=1.334 Ered=−1.453

SS-18

Anhydro-4',5'-benzo-3,3'-bis(3-sulfopropyl)-5-phenyloxathiacyanine hydroxide, triethylammonium salt Eox =1.319 Ered=−1.484

SS-19

Anhydro-5,5'-dichloro-3,3'-bis(2-sulfoethyl)thiacyanine hydroxide, triethylammonium salt Eox=1.469 Ered=−1.206

SS-20

Anhydro-4',5'-benzo-5-methoxy-3,3'-bis(3-sulfopropyl)oxathiacyanine hydroxide, sodium salt Eox=1.283 Ered=−1.530

SS-21

Anhydro-5-cyano-3,3'-bis(3-sulfopropyl)-5'-phenylthiacyanine hydroxide, triethylammonium salt Eox=1.445 Ered=−1.234

SS-22

Anhydro-5'-chloro-5-pyrrolo-3,3'-bis(3-sulfopropyl)oxathiacyanine hydroxide, triethylammonium salt Eox=1.461 Ered=−1.380

SS-23

Anhydro-5,5'-dichloro-3,3'-bis(3-sulfopropyl)thiacyanine hydroxide, triethylammonium salt Eox=1.469 Ered=−1.215

SS-24

Anhydro-5,5'-diphenyl-3,3'-bis(3-sulfopropyl)thiacyanine hydroxide, triethylammonium salt Eox=1.387 Ered=−1.287

SS-25

Anhydro-5-chloro-5'-phenyl-3,3'-bis(3-sulfopropyl)thiacyanine hydroxide, triethylammonium salt Eox=1.428 Ered=−1.251

SS-26

Anhydro-5-chloro-5'-pyrrolo-3,3'-bis(3'-sulfopropyl)thiacyanine hydroxide, triethylammonium salt Eox=1.442 Ered=−1.212

In addition to the features specifically described, it is recognized that the emulsions can contain any convenient conventional selection of additional features. For example, the features of the emulsions, such as vehicle (including peptizers and binders), hardeners, antifoggants and stabilizers, blended grain populations, coating physical property modifying addenda (coating aids, plasticizers, lubricants, antistats, matting agents, etc.), and dye image formers and modifiers can take any of the forms described in *Research Disclosure,* Item 36544, cited above. Selections of these other emulsion features are preferably undertaken as taught in the patents cited above to describe the starting tabular grain emulsions.

EXAMPLES

The invention can be better appreciated by reference to the following specific examples. The term "oxidized gelatin" is employed to indicate gelatin that has been treated with hydrogen peroxide to reduce its methionine content below detectable levels. pH was lowered by using nitric acid and increased by using sodium hydroxide.

Example 1

Host Tabular Grain Emulsion HT-1

A silver bromide host tabular grain emulsion was prepared by charging a reaction vessel with 1.25 g/L of oxidized gelatin, 1.115 g/L NaBr, 0.1 g/L of block copolymer A, and 6 L of distilled water.

$HO-[(CH_3)CHCH_2O]_x-(CH_2CH_2O)_y-[CH_2CH(CH_3)O]_{x'}-H$ x=x'=25; y=7 block copolymer A

The contents of the reaction vessel were adjusted to a pH of 1.78 at 40° C. Nucleation occurred during a one minute period during which 0.8 m/L of $AgNO_3$ and 0.84 m/L NaBr were added at the rate of 50 mL/min. The temperature of the reaction vessel was ramped to 60° C. after the addition of 0.0892 mole of NaBr. Ammonia was then generated in situ by the addition of 0.115 mole of ammonium sulfate and 0.325 mole of sodium hydroxide. Ammoniacal digestion was undertaken for 9 minutes, after which time the digestion was quenched by the addition of 0.2265 mole of nitric acid. Additional gelatin, 99.84 g of oxidized gelatin, and surfactant, block copolymer A (1.0 mL) were introduced into the reaction vessel.

A first growth segment (I) then occurred over a period of 20 minutes at a pH of 5.85, pBr of 2.2, 60° C., by introducing NaBr and $AgNO_3$ solutions employed for grain nucleation at the rates of 9.2 and 9.0 mL/min, respectively. A second growth segment (II) took place over 64 minutes by continuing precipitation as described for growth segment I, except that 1.6 mol/L $AgNO_3$ was ramped from 9 to 80 mL/min and 1.679 m/L NaBr was ramped from 9.1 to 78.5 mL/min. A final growth segment was conducted for 19 minutes at the terminal flow rate of growth segment II.

The emulsion was then cooled to 40° C. and adjusted to a pBr of 3.6 during ultrafiltration. The pH of the emulsion was adjusted to 5.9.

The resulting silver bromide tabular grain emulsion was monodispersed, having a COV of less than 30 percent. The average ECD of the emulsion grains was 1.44 μm, and the average thickness of the grains was 0.10 μm. The average aspect ratio of the tabular grains 14.4. Greater than 90 percent of total grain projected area was accounted for by tabular grains.

Composite Tabular Grain Emulsion CT-1

A reaction vessel was charged with 1 mole of Emulsion HT-1. The temperature of the reaction vessel was adjusted to 60° C., and its pBr was brought to 4.0 by the slow addition of $AgNO_3$. The silver content of the grains was increased by 18 percent, based on total silver, by the double jet precipitation of AgI over 10 minutes by adding $AgNO_3$ and KI each at a flow rate of 35 mL/min. while monitoring the pI of the reaction vessel to control host grain metathesis. At the conclusion of precipitation the pI of the reaction vessel was adjusted to 7.1 with KI and the pH was adjusted to 5.6.

Microscopic analysis of the resulting emulsion revealed that in excess of 90 percent of total grain projected area was accounted for by composite tabular grains containing high iodide silver halide plates on their major faces and edges. Greater than 40 percent of the tabular grain major faces were covered by the high iodide plates. Scanned probe microscopy revealed that the plates varied from 4 to 6 nm in thickness. The plates were observed to contain β phase silver iodide, but the presence of γ phase silver iodide could not be excluded. Analytical electron microscopy observations were consistent with the plates having a high (>90 mole %) iodide content. A measured lattice constant of 6.5 Å was observed, compared to a known lattice constant of 6.496 Å for AgI. Some evidence of host grain metathesis was observed, and a nontabular AgI grain population was also present.

Light Absorption Analysis

The emulsion was coated at 10.76 mg/dm$^2$ silver with an equal amount of gelatin on a cellulose acetate photographic support with an anithalation backing layer. The emulsion layer was overcoated with 21.53 mg/dm$^2$ of gelatin containing 1.5 percent by weight, based on total gelatin, of bis(vinylsulfonyl)methane hardener. A second, identical coating was prepared, except that the antihalation backing was omitted. Third and fourth coatings identical to the first and second coatings were prepared, except that Emulsion HT-1 was substituted for Emulsion CT-1.

Figure 3:
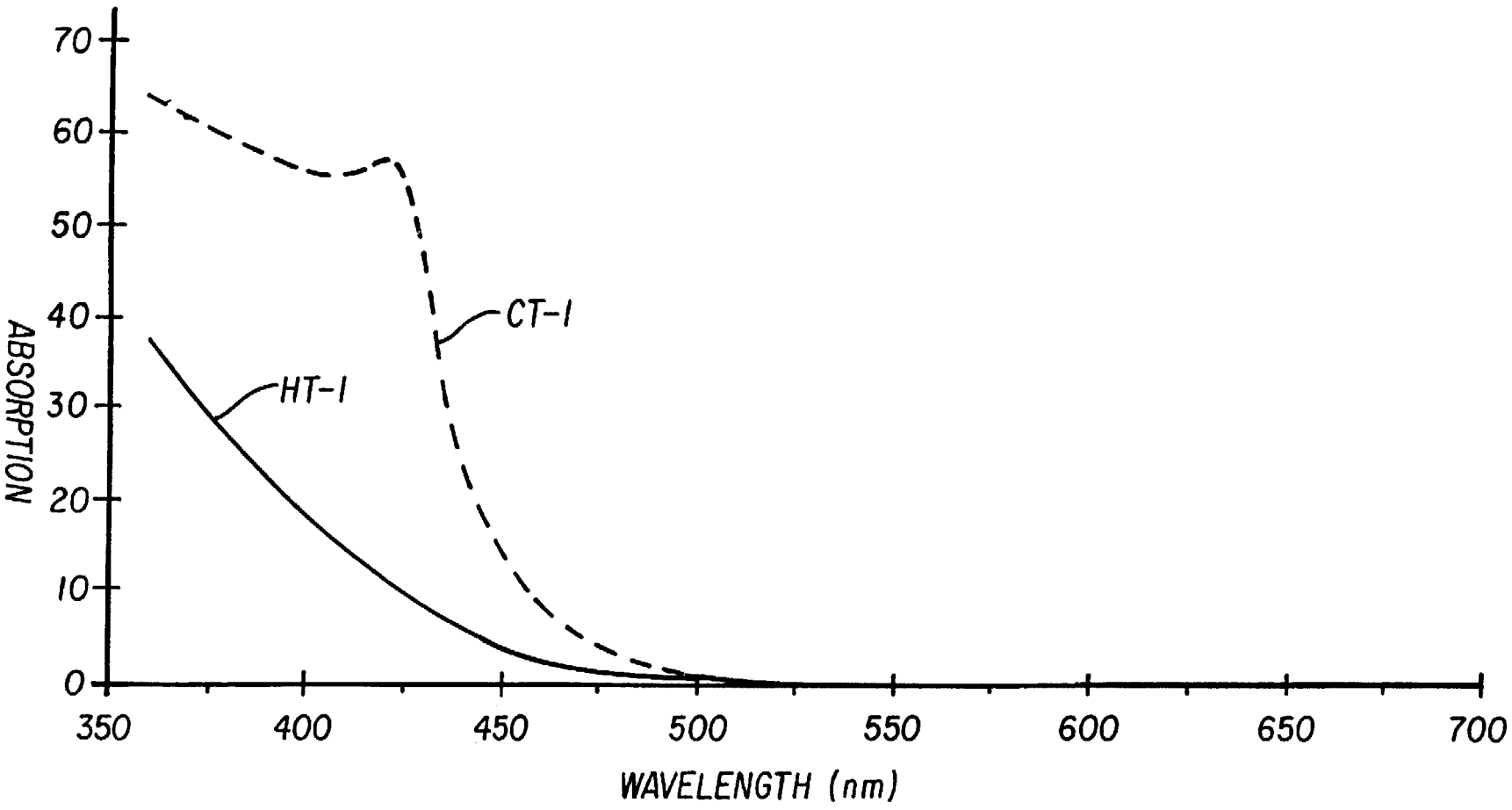
FIGS. 3, 6 and 9 are plots of percent light absorption as a function of wavelength.

From reflection and transmission analysis the absorptions of Emulsions HT-1 and CT-1 as a function of wavelength were determined and are represented as shown in FIG. 3. Emulsion CT-1 demonstrated a significantly higher absorption that Emulsion HT-1 up to wavelengths approaching 500 nm. Peak absorption of Emulsion HT-1 was observed at 423 nm. Multiplying the spectral output of a 5500° K. Daylight V light source by the absorptions of FIG. 3 over the wavelength region of 360 to 700 nm gives an integrated light absorption of $175\times10^{10}$ photons/cm$^2$/sec for Emulsion HT-1 and $745\times10^{10}$ photons/cm$^2$/sec for Emulsion CT-1. This demonstrates somewhat more than 4 times greater photon absorption for Emulsion CT-1 as compared to Emulsion HT-1.

Example 2

Host Tabular Grain Emulsion HT-2

A silver iodobromide host tabular grain emulsion was prepared by charging a reaction vessel with 2 g/L of gelatin (Rousselot™), 6 g/L NaBr, 0.65 mL of block copolymer A, and 4956 mL of distilled water. The contents of the reaction vessel were adjusted to a pH of 6.0 at 40° C. at a pBr of 1.35. The temperature of the reaction vessel was then raised to 70° C. Nucleation occurred during a three minute period during which 0.393 m/L of $AgNO_3$ at a rate of 87.6 mL/min and 2 m/L NaBr at a rate of 20 mL/min were added. An ammonia digest was initiated by adding 0.27 mole of $NH_4OH$. Ammoniacal digestion was undertaken for 1.5 minutes, after which time the digestion was quenched by the addition of 0.37 mole of nitric acid.

Distilled water in the amount of 1820 mL containing 77 g/L of gelatin with 0.25 mL of block copolymer A was added to the reaction vessel. A first growth segment (I) was then conducted over 3.0 minutes by introducing 87.6 mL/min of the 0.393 m/L $AgNO_3$ and 13.2 mL/min of the 2 m/L NaBr while maintaining a pBr of 1.55. A second growth segment (II) was conducted over 25 minutes by adding 2.75 m/L $AgNO_3$ and 2.7085 m/L NaBr containing 0.04125 m/L KI, each at accelerating flow rates ranging from 15 to 40 mL/min. A third growth segment (III) was a continuation of the preceding growth segment, lasting 31 minutes with addition of the same solutions being accelerated from 40 to 102 mL/min. NaBr in the amount of 1.925 moles in 665 g of distilled water were then added followed by the dump addition of 0.36 mole of AgI Lippmann. $AgNO_3$ at 2.75 m/L and 2 m/L NaBr were then each run into the reaction vessel at a constant rate of 50 mL/min until the pBr of the reaction vessel reached 2.4 (approximately 24 minutes).

The emulsion was washed at 40° C. to a pBr of 3.6 by ultrafiltration. The pH of the emulsion was adjusted to 5.6.

The emulsion was a run-dump silver iodobromide tabular grain emulsion. The grains contained 1.5 mole % I added during the run and 3 mole % I added in the dump following precipitation of 69 percent of total silver.

The resulting silver iodobromide tabular grain emulsion was monodispersed, having a COV of less than 30 percent. The average ECD of the emulsion grains was 3.25 μm, and the average thickness of the grains was 0.13 μm. The average aspect ratio of the tabular grains 25. Greater than 70 percent of total grain projected area was accounted for by tabular grains.

Composite Tabular Grain Emulsion CT-2

Formation of this emulsion followed the description provided above for the preparation of Emulsion CT-1, except as noted. Emulsion HT-2 was substituted for Emulsion HT-1. The temperature of the reaction vessel was 65° C. $AgNO_3$ and KI were added in two 10 minute growth segments. In the first segment the $AgNO_3$ addition was accelerated from 3.5 to 17.5 mL/min while KI addition was accelerated from 5 to 25 mL/min. In the second segment the $AgNO_3$ addition was accelerated from 17.5 to 35 mL/min while KI addition was accelerated from 25 to 50 mL/min. The additional AgI precipitated accounted for 20.6 percent of total silver forming the composite grains.

Figure 4:
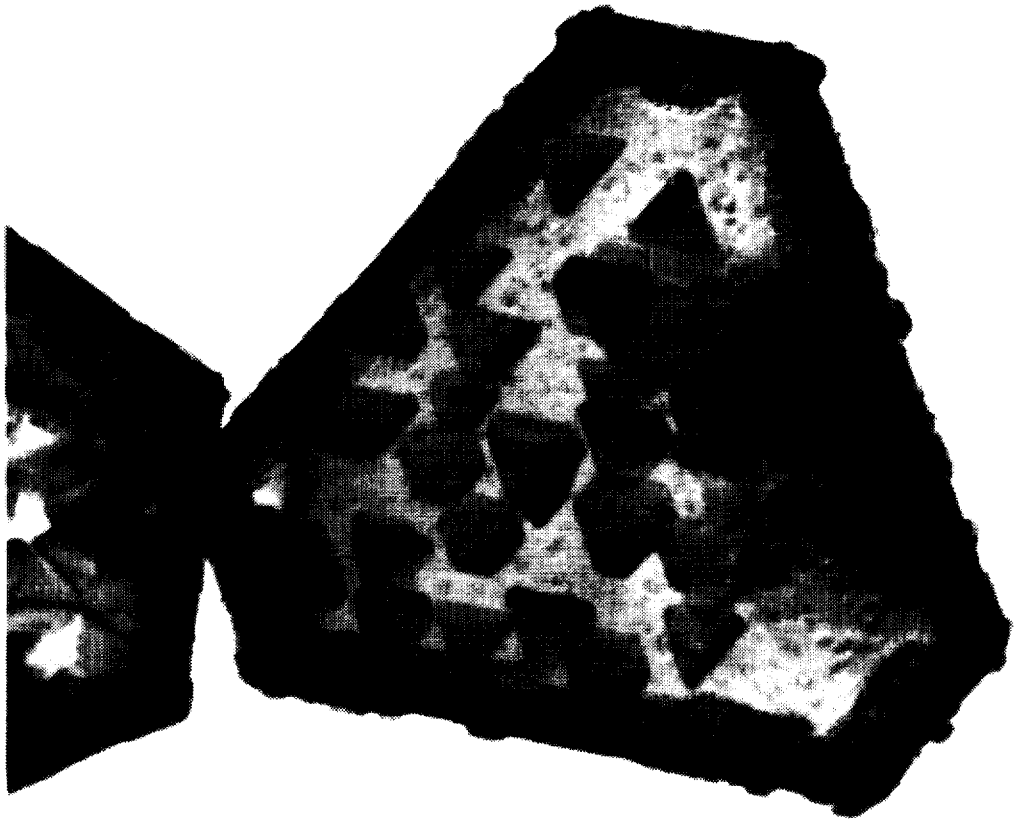
FIGS. 4 and 5 are transmission electron micrographs of the face and edges, respectively, of tabular grains from an emulsion according to the invention.
Figure 5:
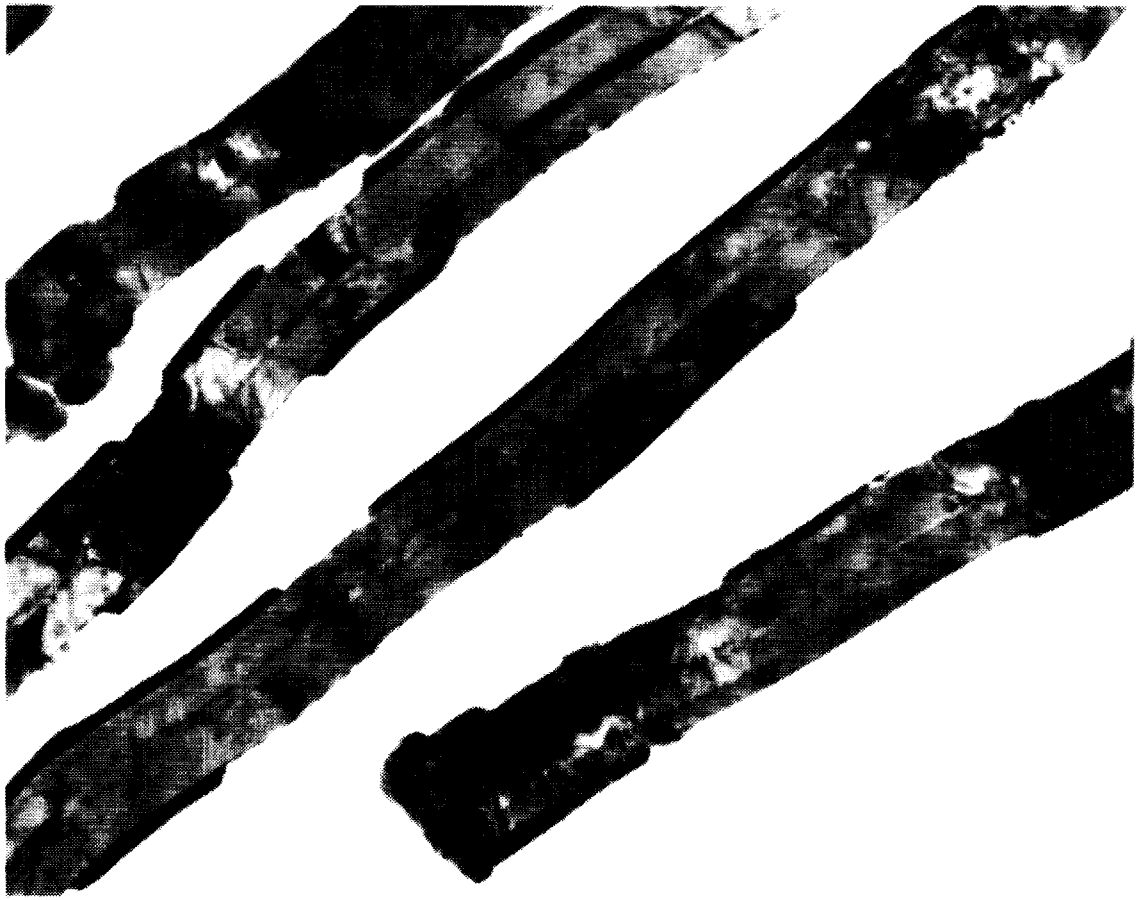

Microscopic analysis of the resulting emulsion revealed that in excess of 95 percent of total grain projected area was accounted for by composite tabular grains containing triangular and hexagonal high iodide silver halide plates on their major faces and edges. Greater than 55 percent of the tabular grain major faces were covered by the high iodide plates. Scanned probe microscopy revealed that the plates varied from 15 to 30 nm in thickness. Plates were also observed on the edges of the host tabular grains. A plan view of a typical grain is shown in FIG. 4, and a section view of typical grains is shown in FIG. 5.

Iodide analysis revealed three distinct phases—the run iodide, the dump iodide and the iodide in the plates. The lattice constant of the crystal lattice of the plates was 6.4, indicating a high (>90 mole %) iodide phase, probably containing a small fraction of bromide ion.

Light Absorption Analysis

The light absorption analysis of Example 1 was repeated using Emulsions HT-2 and CT-2, except additional samples of these emulsions were examined with the blue spectral sensitizing dye SS-23 added at concentrations of 600 mg/Ag mole.

Figure 6:
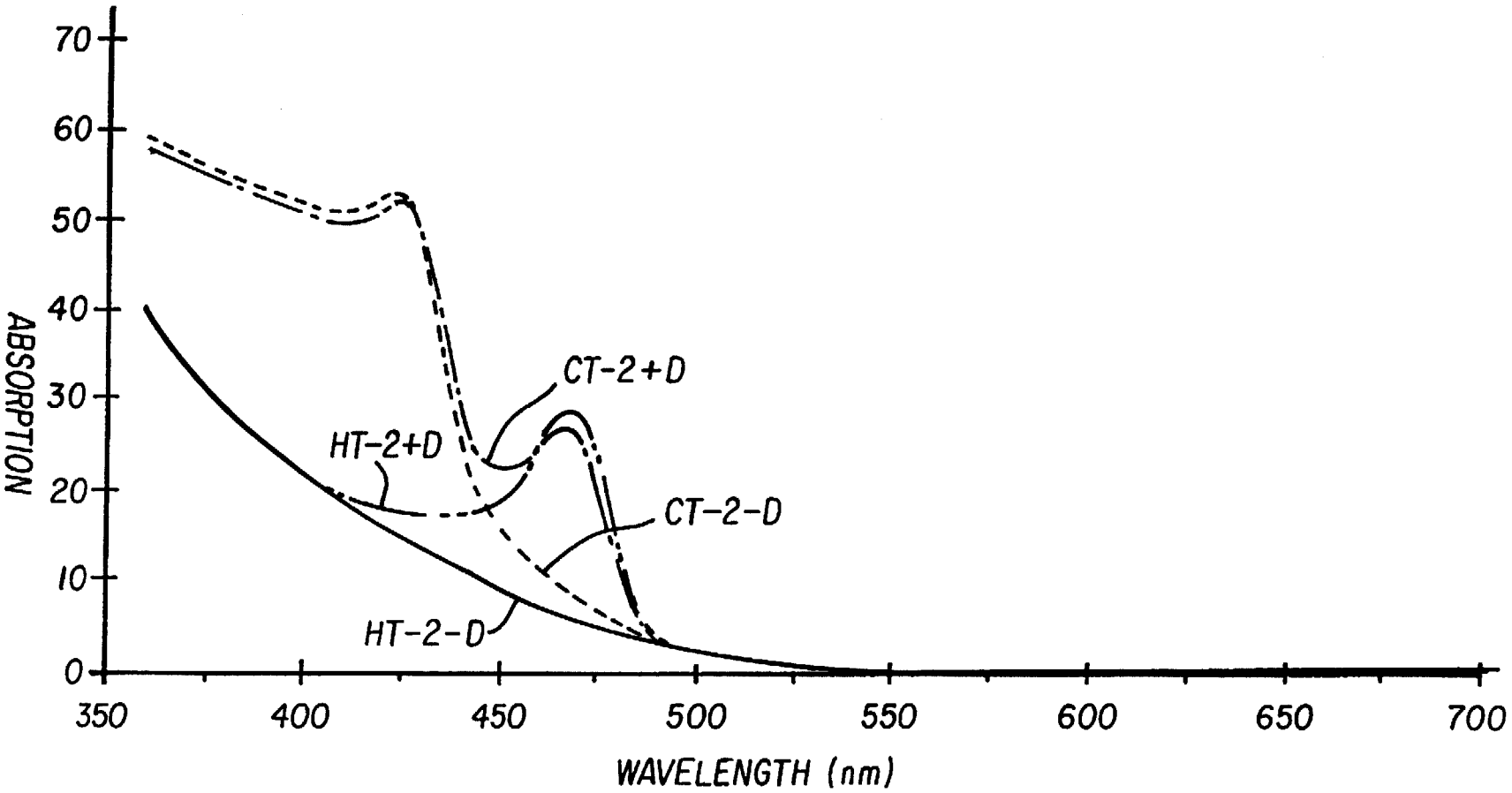

From reflection and transmission analysis the absorptions of dyed and undyed samples Emulsions HT-2 and CT-2 as a function of wavelength were determined and are represented as shown in FIG. 6. Emulsion HT-2 without dye is shown as curve HT-2-D. It exhibits the least absorption in the blue region of the spectrum. Emulsion HT-2 with dye is shown as curve HT-2+D shows increased blue absorption, attributable to the spectral sensitizing dye, with peak absorption occurring in the long blue portion of the spectrum. Emulsion CT-2 without dye, shown as Curve CT-2-D, shows blue absorption superior to that of HT-2-D and shows short blue absorption superior to that of HT-2+D. Emulsion CT-2 with dye, shown as Curve CT-2+D, shows superior overall blue absorption as compared with the remaining emulsion samples.

Multiplying the spectral output of a 5500° K. Daylight V light source by the absorptions of FIG. 6 over the wavelength region of 360 to 700 nm gives the integrated light absorptions shown in Table II.

TABLE II

| Emulsion Sample | Integrated Light Absorption photons/sec/cm$^2$ |
|---|---|
| HT-2 – D | $294 \times 10^{10}$ |
| CT-2 – D | $729 \times 10^{10}$ |
| HT-2 + D | $630 \times 10^{10}$ |
| CT-2 + D | $959 \times 10^{10}$ |

This demonstrates the superior blue light absorption that are available by employing the emulsions of the invention.

Example 3

Composite Tabular Grain Emulsion CT-3

Starting with HT-2, but with the pBr of the emulsion adjusted to 5.06, the preparation procedure for CT-2 was repeated, but with these differences: The second growth segment in which $AgNO_3$ and KI were added was reduced to 6.1 minutes. In the first growth segment KI addition was accelerated from 4 to 10 mL/min and in the second growth segment KI addition was accelerated from 10 to 16.1 mL/min. The $AgNO_3$ flow in the second growth segment ended at 28.2 mL/min. The total AgI precipitated accounted for 9.2 percent of total silver forming the composite grains.

Figure 8:
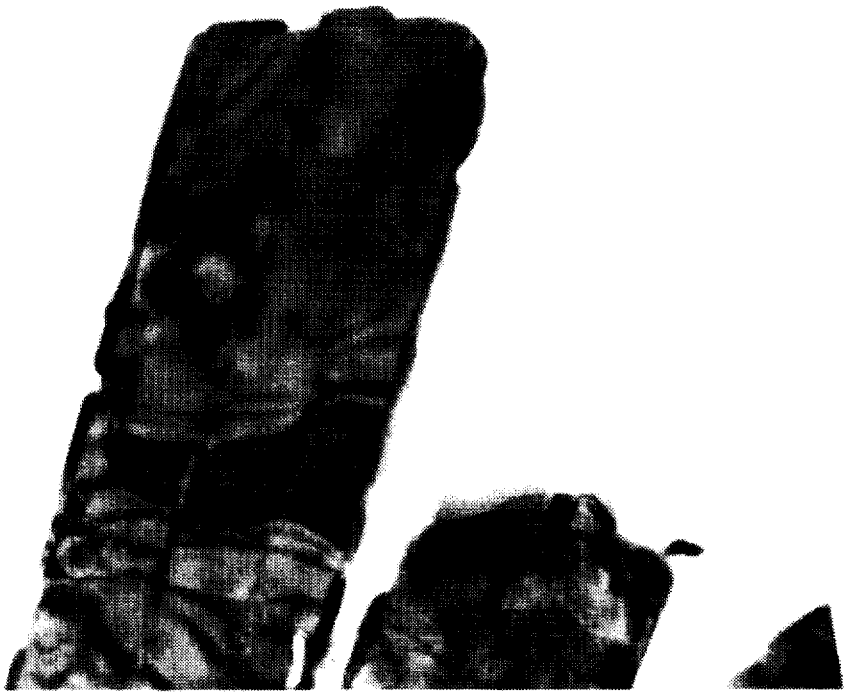

A plane view of a typical grain is shown in FIG. 7, and a section view of typical grains is shown in FIG. 8. Compared to Emulsion CT-2, there were fewer high iodideplates at the edges of the host tabular grains. Also, instead of being discrete with triangular or hexagonal boundaries, the plates appeared to coalesce with adjacent plates, leaving no discernible boundaries between adjacent plates.

Example 4

Host Tabular Grain Emulsion HT-4

A silver iodobromide host tabular grain emulsion was prepared by charging a reaction vessel with 0.80 g/L of oxidized gelatin, 0.851 g/L NaBr, 0.7 g/L of block copolymer B, and 6 L of distilled water.

$HO-(CH_2CH_2O)_y-[(CH_3)CHCH_2O]_x-(CH_2CH_2O)_{y'}-H$ x=22; y=y'=6 block copolymer B

The contents of the reaction vessel were adjusted to a pH of 1.78 at 45° C. Nucleation occurred during a one minute period during which 0.5 m/L of $AgNO_3$ and 0.54 m/L NaBr were added at the rate of 58 mL/min. The temperature of the reaction vessel was ramped to 60° C. after the addition of 0.098 mole of NaBr. Ammonia was then generated in situ by the addition of 0.077 mole of ammonium sulfate and 0.241 mole of sodium hydroxide. Ammoniacal digestion was undertaken for 9 minutes, after which time the digestion was quenched by the addition of 0.21 mole of nitric acid. Additional gelatin (150.0 g of oxidized gelatin), NaBr (0.123 mole), and block copolymer B (1.4 mL) were introduced into the reaction vessel.

A first growth segment (I) then occurred over a period of 20 minutes at a pH of 5.5, pBr of 1.6, 60° C., by introducing NaBr and $AgNO_3$ solutions employed for grain nucleation at the rates of 15 and 16.7 mL/min, respectively. A second growth segment (II) took place over 75 minutes by continuing precipitation as described for growth segment I, except that 1.6 mol/L $AgNO_3$ was ramped from 9 to 69 mL/min and 1.622 m/L NaBr plus 0.0676 KI was ramped from 9.6 to 69 mL/min. A third growth segment (III) occurred for 8.5 minutes at the final addition rate of the second growth segment. A final growth segment was conducted for 20 minutes at the flow rate of growth segment III, except that 1.69 m/L NaBr was substituted for NaBr plus KI for the purpose of reducing the iodide concentration at the surface of the tabular grains during the precipitation of the final 20 percent of silver deposition.

The emulsion was then cooled to 40° C. and adjusted to a pBr of 3.5 during ultrafiltration. The pH of the emulsion was adjusted to 5.5.

The resulting silver iodobromide tabular grain emulsion was monodispersed, having a COV of less than 30 percent. The average ECD of the emulsion grains was 2.87 μm, and the average thickness of the grains was 0.098 μm. The average aspect ratio of the tabular grains was 29.3. Greater than 90 percent of total grain projected area was accounted for by tabular grains.

Partially Shelled Tabular Grain Control ST-4

A one mole sample of Emulsion HT-4 was partially shelled by depositing silver iodobromide (36 mole % I) as a shell over the exterior of the host tabular grains. A total of 0.225 mole of $AgBr_{0.64}I_{0.36}$ was deposited over 38.5 minutes by the double jet addition of $AgNO_3$ as a silver salt solution and a mixture of NaBr and KI as a mixed halide salt solution. Shell precipitation was conducted at 65° C. and a pBr of 3.6. A total of 0.0918 mole of silver iodide was precipitated in the shell.

Microscopic examination of the grains revealed that the shell covered all visible exterior edge faces of the host tabular grains and 40 percent of the total exterior surface. Shell growth began at the edges of the grains, entirely covering the edges, and then progressed inwardly as precipitation continued, entirely covering all areas of the major faces closer to the edges than the boundaries of the partial shell nearest the centers of the major faces.

Composite Tabular Grain Emulsion CT-4

The shelling procedure of Emulsion ST-4 was modified to eliminate the bromide added with the iodide. This resulted in the precipitation of 0.0919 mole of silver iodide onto the host tabular grain emulsion HT-4.

Microscopic analysis of the resulting emulsion revealed that in excess of 90 percent of total grain projected area was accounted for by composite tabular grains containing high iodide silver halide plates on their major faces and edges. Greater than 15 percent of the tabular grain major faces were covered by the high iodide plates.

Light Absorption Analysis

The light absorption analysis of Example 2 was repeated using Emulsions HT-4, ST-4 and CT-4, but with 800 g of blue spectral sensitizing dye SS-23 per silver mole adsorbed.

Figure 9:
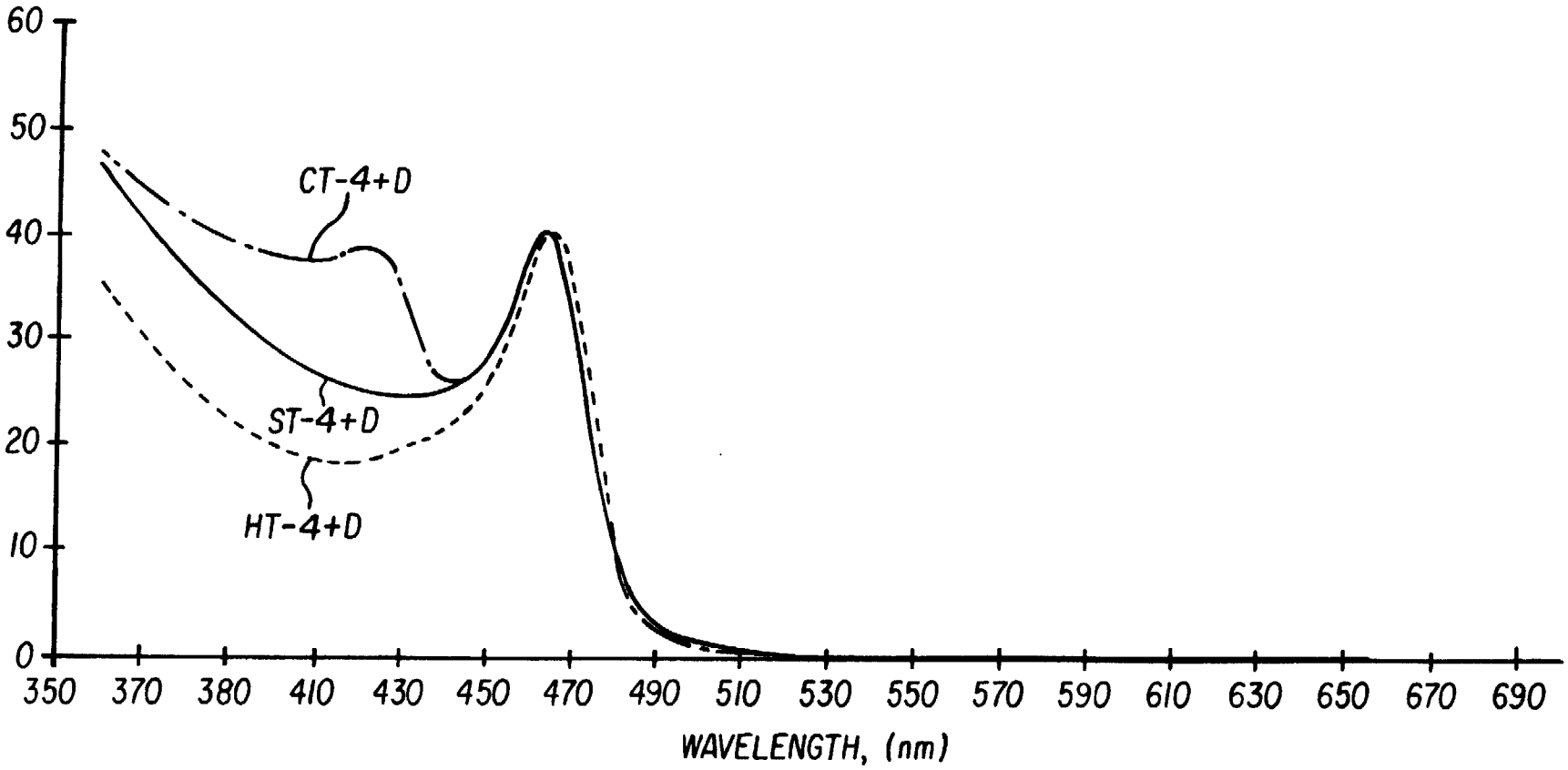

The absorption performance of dyed samples is shown in FIG. 9. All of the dyed samples demonstrated similar absorption in the long (450 to 500 nm) blue region of the spectrum; but in the short (400 to 450 nm) blue region of the spectrum, a clear separation on absorptions was observed. Minimum short blue absorption was demonstrated by Emulsion HT-4 with dye (HT-4+D). When iodide was increased by creating a silver iodobromide shell, a clear increase in blue absorption was observed for Emulsion ST-4 plus dye (ST-4+D). However, the short blue absorption of ST-4+D was limited by the limited ability to incorporate iodide into the face centered cubic rock salt crystal lattice structure forming the shell. The superiority of forming a high iodide phase on the major faces of the host tabular grains is shown by the dyed sample of Emulsion CT-4 (CT-4+D).

Multiplying the spectral output of a 5500° K. Daylight V light source by the absorptions of samples of Emulsions HT-4, ST-4 and CT-4, with (+D) and without (–D) dye, over the wavelength region of 360 to 700 nm gives the integrated light absorptions shown in Table III.

TABLE III

| Emulsion Sample | Integrated Light Absorption photons/sec/cm$^2$ |
|---|---|
| HT-4 – D | $224 \times 10^{10}$ |
| ST-4 – D | $369 \times 10^{10}$ |
| CT-4 – D | $498 \times 10^{10}$ |
| HT-4 + D | $807 \times 10^{10}$ |
| ST-4 + D | $849 \times 10^{10}$ |
| CT-4 + D | $995 \times 10^{10}$ |

This demonstrates the superior blue light absorption that is available by employing the emulsions of the invention. It further demonstrates that similar levels of light absorption can not be realized by adding the same amount of iodide as in the emulsions of the invention, but in a surface silver iodobromide shell. Even though CT-4 contained a high iodide phase covering only a minimal 15 percent of its major faces, it compared favorably to ST-4 that contained a silver iodobromide phase of the same overall iodide content distributed over 40 percent of its major faces.

Example 5

Host Tabular Grain Emulsion HT-5

A silver iodobromide (3 mole % I) tabular grain emulsion was precipitated in the following manner: A reaction vessel was charged with 0.667 g/L gelatin, 1.25 g/L NaBr and 6.3 L of distilled water at 70° C. The contents of the reaction vessel were brought to a pH of 3.5 with nitric acid. Nucleation occurred over a 10 sec period by the double jet addition of 1.4M $AgNO_3$ at 75 mL/min and a salt at the same flow rate containing 1.386M NaBr and 0.014M KI. The contents of the reaction vessel were held for 6 minutes and then the temperature was ramped to 80° C. over a period of 7 minutes. Then 1.5 L of a solution containing 20 g/L of gelatin were added, and pH was adjusted to 4.5 with NaOH. Six growth segments (I–VI) defining the remainder of the precipitation were conducted at 80° C., a pH 4.5 and a pBr of 1.78 using 2.5M $AgNO_3$ and 2.425M NaBr containing 0.075M KI.

Growth I took 4.5 min with silver flowing at 15.7 mL/min and the salts at 23.6 mL/min. Growth II extended for 9 minutes during which time the silver flow rate was ramped from 15.7 to 27.3 mL/min, and the flow rate of the salts was ramped from 16.7 to 28.4 mL/min. Growth III was the same time as growth II, except that the respective flow rate ramps were 27.3 to 40.9 and 28.4 to 42.5 mL/min. Growth IV extended over 13.5 minutes with the respective flow rate ramps of 40.9 to 66.1 and 42.5 to 68 mL/min. Growth V took the same time as Growth IV with the respective flow rate ramps of 66.1 to 97.2 and 68 to 99.8 mL/min. Growth VI was 18 minutes long, and the respective flow rate ramps were 97.2 to 120.7 and 99.8 to 123.8 mL/min.

The emulsion was cooled to 40° C. and adjusted to a pBr of 3.6 during ultrafiltration. The pH of the emulsion was adjusted to 5.9. The resulting silver iodobromide tabular grain emulsion had a COV of less than 36 percent. The average ECD of the emulsion grains was 2.48 μm, and the average thickness of the grains was 0.106 μm. The average aspect ratio of the tabular grains was 23.4. Greater than 90 percent of the total grain projected area was accounted for by tabular grains.

Shelled Tabular Grain Control ST-5

Shelled tabular grain control ST-5 was precipitated similarly as ST-4 only using HT-5 as the substrate and at a pBr of 5.06 rather than 3.6.

The shelled grains exhibited an average ECD of 2.81 μm and an average grain thickness of 0.137 μm. Average aspect ratio was 20.1. The iodide concentration of the shell was 38 mole percent, raising the overall iodide concentration of the shelled grains to 10.0 mole percent.

Composite Tabular Grain Emulsion CT-5

This emulsion was prepared similarly to composite tabular grain emulsion CT-4, except that host tabular grain emulsion HT-5 was employed as a substrate and precipitation was conducted at a pBr of 5.06 rather than 3.6.

The composite tabular grains exhibited an average ECD of 2.88 μm and an average grain thickness of 0.116 μm. Average aspect ratio was 24.8. The overall iodide concentration of the composite grains was 9.9 mole percent.

Sensitization

Prior to chemical sensitization, both ST-5 and CT-5 were adjusted to a pBr of 4.37 and epitaxially deposited with 8.0 mole % AgCl using SS-1 at 431.4 mg/Ag mole as a dye director as taught by Maskasky, U.S. Pat. No. 4,459,353. Subsequently chemical sensitization was effected by the sequential addition of 60 mg/Ag mole of NaSCN, 4 mg/Ag mole of N,N'-dicarboxymethyl-N,N'-dimethylthiourea, 2 mg/Ag mole of Au(I) bis(trimethylthiotriazole), and 2.5 mg/Ag mole of 3-methyl-1,3-benzothiazolium iodide to the emulsion melt followed by a 5 min. temperature hold at 50° C. At the conclusion finish of the heat cycle, 115 mg/Ag mole of 1-(3-acetamidophenyl)-5-mercaptotetrazole (APMT) were added to the melt.

Film coatings were made on a cellulose acetate photographic film support with an antihalation backing layer. ST-5 and CT-5 were doctored with 1.750 gm/Ag mole of 4-hydroxy-6-methyl-1,3,3a,7-tetra-azaindene and coated at the following coating coverages: silver halide 10.76 mg/dm$^2$, gelatin 32.28 mg/dm$^2$, and 9.684 mg/dm$^2$ of the yellow dye-forming coupler YC-1. The emulsion layer was overcoated with 8.610 mg/dm$^2$ gelatin, to which 1.5 percent by weight, based on total coated gelatin, bis(vinylsulfonyl) methane hardener was added.

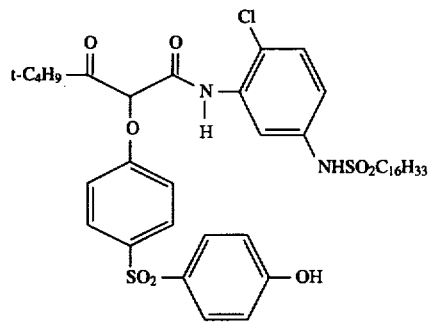

The coated emulsions were given a sensitometric exposure for 1/50" through a 0–3 step chart from 400 to 500 nm in 10 nm increments and then processed in the motion picture film process ECN-2 described in Kodak Publication H-24, *Manual for Processing Eastman Color Films.*

The relative speeds reported in Table IV below were based on the reciprocals of the lux-second/cm$^2$ required to give a density 0.2 unit above Dmin.

TABLE IV

| 430 nm (peak AgI absorption) | | | | 480 nm (peak dye absorption) |
|---|---|---|---|---|
| Emulsion | Dmin | Gamma | Relative Speed | Relative Speed |
| ST-5 | 0.36 | 0.13 | 100 | 100 |
| CT-5 | 0.17 | 0.67 | 2230 | 2200 |

It can be readily appreciated that the tabular grain emulsion of the present invention is, by reason of the high iodide epitaxial phase partially covering the major faces of the tabular, superior to a comparable tabular grain emulsion, but with an iodide saturated silver iodobromide shell substituted for the high iodide epitaxial phase. The advantage is observed in both the long and short blue regions of the spectrum.

Example 6

This example demonstrates that higher levels of photographic performance are realized when the spectral sensitizing dye employed has a reduction potential more negative than −1.30 volts. A high chloride second epitaxial phase was employed for chemical sensitization.

Host Tabular Grain Emulsion HT-6

A silver iodobromide host tabular grain emulsion was prepared by charging a reaction vessel with 2.083 g/L of gelatin (Rousellot™), 6.25 g/L NaBr, 0.271 g/L of the surfactant Emerest 2648™, a dioleate ester of polyethylene glycol (mol. wt. 400) (S6), and 6 L of distilled water. The contents of the reaction vessel were adjusted to a pH of 6.0 at 40° 0 C. after which the temperature was raised to 75° C. Nucleation occurred during a one minute period during which 0.50 m/L of $AgNO_3$ and 2.0 m/L of NaBr were added at a rate of 62.0 mL/min and 22.8 mL/min, respectively. Ammonia was then generated in situ by the addition of 0.0282 mole of ammonium sulfate and 0.086 mole of sodium hydroxide, which brought the reaction vessel to a pH of 10.2. Ammoniacal digestion was undertaken for 1.5 minutes after which time the digestion was quenched by the addition of 0.07 mole of nitric acid. An additional 176.25 g of gelatin (Rousellot™), Surfactant S6, and 0.122 mole of NaBr were introduced into the reaction vessel such that the pBr was brought to 1.343 at 75° C. The pH was then adjusted to 6.0 with NaOH.

A first growth segment (I) then occurred over a period of 3 minutes at a pH of 6.0, a pBr of 1.343, and a temperature of 75° C. by introducing the silver nitrate solution employed for grain nucleation at a rate of 85.3 mL/min and a 2.75 m/L mixed salt solution (1.5% KI, 98.5% NaBr) at a rate of 18.7 mL/min. A second growth segment (II) took place over 25 minutes by continuing precipitation as described for growth segment I, except that 2.75 mol/L $AgNO_3$ was ramped linearly from 18.8 to 50.0 mL/min and the mixed halide salt was ramped linearly from 21.2 to 53.8 mL/min. A third growth segment (III) was undertaken for 31 minutes employing the same reagents as in growth segment II. The flow rates were ramped to 127.5 and 132.2 mL/min, respectively. A fourth growth segment (IV) used these terminal flow rates for an additional 1.5 minutes. A final growth segment (V) employed a single $AgNO_3$ jet for 3.25 minutes to impart a pure bromide character to the last 5% of the emulsion.

The emulsion was then cooled to 40° C. and adjusted to a pBr of 3.378 during ultrafiltration. The pH of the emulsion was adjusted to 5.6.

The resulting AgIBr tabular grain emulsion contained 1.5 mole % bulk iodide, based on total silver, and had a COV of 44 percent. The mean ECD of the emulsion grains was 3.29 μm, and the average thickness of the grains was 0.103 μm. The average aspect ratio of the tabular grains was 32. Greater than 90 percent of total grain projected area was accounted for by tabular grains.

Composite Tabular Grain Emulsion CT-6

A 4 L reaction vessel was charged with one mole of HT-6 and 500 mL of distilled water, allowed to equilibrate at 40° C. for 10 minutes and then brought to a temperature of 65° C. In a first growth segment I the pBr was then raised from 3.681 to 5.261 during the first 3 minutes of a 13.4 minute segment in which a double jet addition of 0.25N $AgNO_3$ reagent was linearly ramped from 4.1 to 14.1 mL/min while a 0.4M KI solution was linearly ramped from 4.6 to 8.1 mL/min.

A second growth segment II followed lasting 14.3 minutes in which the silver nitrate was ramped from its final value in segment I to a value of 28.1 mL/min while the KI reagent flow rate was accelerated to 26.8 mL/min. This and a following segment were controlled at a pBr of 5.261. A final growth segment III featuring constant flow rates at these terminal values was sufficient to confer an overall additional bulk iodide content of 9.2 mole %, based on total silver forming the composite grains. The iodide present consisted essentially of a pure β phase AgI composition.

Second Epitaxial Phase

A second epitaxial phase was grown onto the corners of the tabular grains contained in samples of emulsions HT-6 and CT-6.

A 800 mL reaction vessel was charged with 0.5 mole of HT-6 or CT-6. Addition of 0.25N $AgNO_3$ was used to raise the pBr from 3.394 to 4.827 at 40° C. Sufficient sodium chloride was then added to the reaction vessel to bring its concentration to 4 mole %. The emulsion was then dyed with one of the spectral sensitizing dyes identified below in an amount (0.981 mole) calculated to cover 75% of the emulsion surface area (383.5 $m^2$/Ag mole). A double jet precipitation of 1.0M $AgNO_3$ and 1.0M NaCl at 22.9 mL/min for 1.75 minutes was sufficient to generate AgCl epitaxial deposits almost exclusively confined to the corners of the tabular grains in an amount totaling 8 mole %, based on total silver. The analyzed composition of these deposits in HT-6 emulsion samples was 65% AgCl, 30% AgBr and 5% AgI.

Sensitometric Evaluation

To each sample receiving the second epitaxial phase as described above were added at 40° C. in sequence the following reagents in millimoles per silver mole with 5 minute holds between each successive addition: 1.2335 mmoles of NaSCN, 0.02727 mmole of N,N'-dicarboxymethyl-N,N'-dimethylthiourea, 0.0035 mmole of Au(I) bis(trimethylthiotriazole), and 2.5 mg of 3-methyl-1,3-benzothiazolium iodide. Chemical sensitization was effected by raising the emulsion melt containing addenda to 50° C. and holding for 7.5 minutes. Subsequently, the melt was cooled to 40° C., and 0.6453 millimole of 1-(3-acetamidophenyl)-5-mercaptotetrazole (APMT) was introduced. The melt was then prepared for coating.

Single emulsion layer coatings were formulated containing 10.76 mg/$dm^2$ of silver halide, three times that amount of gelatin, and 9.684 mg/$dm^2$ of the yellow dye-forming coupler YC-1. The dye-forming coupler containing emulsion layer was overcoated with 8.608 gm/$dm^2$ of gelatin and hardened with 1.5 percent by weight of bis(vinylsulfonyl) methane.

Coatings were exposed through a 0–4 density step tablet for 1/50" using a Wratten 2B™ filter with a 0.6 density inconel filter and a 3000° K. color temperature (tungsten filament balance) light source. The Wratten 2B filter allowed transmission of light having a wavelength longer than 410 nm. A standard 3.25 min development color negative process (Eastman Color Negative™) was used to develop the latent image.

In Table V the relative log speeds (derived from inertial speeds) of the HT-6 and CT-6 emulsions plus AgCl epitaxy host emulsions sensitized with varied dyes are compared.

TABLE V

| Dye/ Red. Potential (volts) | (>410 nm exposures) Rel. Log Speed HT-6 + AgCl epitaxy | Rel. Log Speed CT-6 + AgCl epitaxy |
|---|---|---|
| SS-22/−1.38 | 106 | 121 |
| SS-4 /−1.37 | 125 | 133 |
| SS-1 /−1.36 | 114 | 119 |
| SS-21/−1.23 | — | 102 |
| SS-23/−1.22 | 133 | 100 |

From Table V it is apparent that the presence of the high iodide plates on the major faces of the host grains increased the speed of the emulsions exposed to light in the wavelength ranges which the dyes were capable of absorbing when spectral sensitizing dyes SS-3, SS-4 and SS-22 were employed. From this it was concluded that when the spectral sensitizing dye has a reduction potential more negative than −1.30 volts (preferably more negative than −1.35 volts) the spectral sensitizing dye is capable of injecting electrons into the high iodide plates on exposure and a higher photographic speed can be expected. In the absence of any spectral sensitizing dye the high iodide plates produce a very large speed advantage, as demonstrated above in Example 5.

Example 7

This example demonstrates that when a spectral sensitizing dye having a reduction potential more negative than −1.30 (preferably −1.35) volts is employed in combination with a compound having a reduction potential more negative than that of the spectral sensitizing dye (preferably having a reduction potential more negative than −1.40 volts) and is limited to a molar concentration of 35 percent or less, based on the compound and the spectral sensitizing dye, a further increase in photographic speed can be realized.

Emulsion CT-6 with AgCl as a second epitaxial phase was prepared, coated and processed as in Example 6, except that a preferred spectral sensitizing dye SS-5 was employed alone or in combination with one of the other dyes shown in Table VI.

TABLE VI

| Spectral Sensitizing Dye | Oxidation Potential (volts) | Reduction Potential (volts) |
|---|---|---|
| SS-23 | 1.47 | −1.22 |
| SS-22 | 1.46 | −1.38 |
| SS-5 | 1.24 | −1.4 |
| SS-2 | 1.09 | −1.76 |

Dye SS-23 represents a non-preferred spectral sensitizing dye lacking a reduction potential more negative than −1.30 volts. Dyes SS-22 and SS-5 are representative of preferred spectral sensitizing dyes. Dye SS-2 demonstrates a spectral sensitizing dye having a more negative reduction potential than any of the remaining spectral sensitizing dyes.

Integrated light absorptions as well as minimum densities (Dmin), contrast (Gamma) and relative log speeds (Speed) for 365 nm Hg line exposures and 3000° K. exposures are summarized in Table VII. The integrated light absorptions were determined as reported in Examples 1 and 5. The 3000° K. exposures correspond to those described in Example 6. The 365 nm Hg line exposures were conducted through a graduated density step tablet similarly as the 3000° K. exposures, but no filters were employed.

TABLE VII

| Dye | 365 Hg Line Dmin | Gamma | Speed | 3000° K. Dmin | Gamma | Speed | Integrated Light Absorption photons/ sec/$cm^2$ |
|---|---|---|---|---|---|---|---|
| SS-5 | 0.25 | 1.02 | 100 | 0.27 | 1.28 | 100 | $550.8 \times 10^{10}$ |
| SS-23(15%) SS-5(85%) | 0.49 | 0.74 | 75 | 0.46 | 0.74 | 74 | $526 \times 10^{10}$ |
| SS-22(35%) SS-5(65%) | 0.24 | 0.92 | 98 | 0.25 | 0.97 | 99 | $334.2 \times 10^{10}$ |
| SS-2(35%) SS-5(65%) | 0.24 | 0.72 | 108 | 0.25 | 0.81 | 111 | $478.6 \times 10^{10}$ |

From Table VII it is apparent that when spectral sensitizing dye SS-5, which is a representative preferred spectral sensitizing dye having a reduction potential more negative than −1.30 volts, is combined with a minor amount of a spectral sensitizing dye that has a more positive reduction potential, SS-23, the result is a loss in photographic speed. When SS-5 is combined with a minor amount of another preferred spectral sensitizing dye having about the same reduction potential, SS-22, a minimal influence on speed is observed. However, when SS-5 is employed in combination with a minor amount of SS-2, a spectral sensitizing dye having a reduction potential more negative than that of SS-5 and more negative than −1.40 volts, the result is a significant increase in photographic speed.

It should be specifically noted that SS-2 used in combination with SS-5 increased speed, even though overall light absorption was less than that obtained with SS-5 alone. Thus, compounds having more negative reduction potentials than the preferred spectral sensitizing dyes can improve photographic speed, even when displacement of the dye by the compound reduces the level of dye absorption.

Example 8

Example 7 was repeated, except that the molar ratios of spectral sensitizing dyes SS-5 and SS-2 were varied. In these investigations the sensitizations also differed from those of Example 7 in that 17% less sulfur sensitizer and 12.5% less gold sensitizer were employed while an additional 0.250 mole of spectral sensitizing dye or dyes was added after the step of holding for 7.5 minutes at 50° C.

The results are summarized in Table VIII.

TABLE VIII

| Dye | 365 Hg Line Dmin | Gamma | Speed | 3000° K. Dmin | Gamma | Speed | Integrated Light Absorption photons/sec/cm$^2$ |
|---|---|---|---|---|---|---|---|
| SS-5 | 0.17 | 0.99 | 100 | 0.17 | 1.01 | 100 | $572.8 \times 10^{10}$ |
| SS-2 | 0.32 | 0.54 | 88 | 0.30 | 0.57 | 71 | $414 \times 10^{10}$ |
| SS-5(95%) SS-2(5%) | 0.16 | 1.01 | 102 | 0.16 | 0.98 | 102 | $562.3 \times 10^{10}$ |
| SS-5(85%) SS-2(15%) | 0.15 | 0.90 | 109 | 0.16 | 0.89 | 107 | $535.8 \times 10^{10}$ |
| SS-5(75%) SS-2(25%) | 0.27 | 0.76 | 97 | 0.26 | 0.80 | 91 | $523.6 \times 10^{10}$ |

From Table VIII it is apparent that a speed enhancement can be realized with a proportion of SS-2 of only 5 mole percent, based on total spectral sensitizing dye. A preferred proportion of dye having a more negative reduction potential is up to 20 mole % of the total dye, although a proportion of SS-2 of up to 35 mole % is shown to be advantageous in Example 7.

Example 9

This demonstrates that the addition of a SET dopant to the AgCl epitaxy can be relied upon to further increase photographic speed.

An emulsion was prepared, coated, exposed and processed similar as CT-6, except that the sensitization was varied by adding SET-11 during deposition of the AgCl epitaxy in the concentrations set out in Table IX and the sensitization was varied as follows: Formation of the second epitaxial phase spectral sensitizing dye SS-1 was added in the amount of 0.39 mmole per silver mole. Then to each sample were added at 40° C. in sequence the following reagents in millimoles per silver mole with 5 minute holds between each successive addition: 0.617 mmole of NaSCN, 0.0355 mmole of N,N'-dicarboxymethyl-N,N'-dimethylthiourea, 0.0070 mmole of Au(I) bis(trimethylthiotriazole), and 2.5 mg of 3-methyl-1,3-benzothiazolium iodide. Chemical sensitization was effected by raising the emulsion melt containing addenda to 50° C. and holding for 7.5 minutes. Subsequently, the melt was cooled to 40° C., and 0.6453 millimole of 1-(3-acetamidophenyl)-5-mercaptotetrazole (APMT) was introduced. The melt was then prepared for coating.

The results are summarized in Table IX.

TABLE IX

| Dopant Level (mppm ΣAg) | Relative Speed | Gamma |
|---|---|---|
| 0 | 100 | 0.42 |
| 1.5* | 106 | 0.63 |

*Introduced in first 25% of AgCl epitaxy

*Introduced in first 25% of AgCl epitaxy

The SET-11 dopant increased speed and contrast when incorporated in a concentration of 1.5 molar parts per million (mppm), based on total silver forming the grains. The local concentration of the dopant within the AgCl epitaxy was 18.75 mppm.

Example 10

This demonstrates that the addition of a SET dopant to the host tabular grains can be relied upon to further increase photographic speed.

Example 9 was repeated, except that the SET dopant, SET-2, was added only during precipitation of the host tabular grains. Dopant addition began after precipitation of X% of total silver forming the host tabular grains and was terminated when Y% of the total silver had been precipitated. See Table X below for actual X and Y values. The local concentration of the SET-2 dopant was 250 mppm in all instances. Additionally, the concentrations of the chemical sensitizers were varied as follows: 1.851 mmole of NaSCN, 0.0178 mmole of N,N'-dicarboxymethyl-N,N'-dimethylthiourea, and 0.0035 mmole of Au(I) bis(trimethylthiotriazole). Spectral sensitization was varied by adding a 15% SS-2 and 85% SS-5 mixture after holding at 50° C. for 7.5 minutes.

The results with and without SET-2 dopant are summarized in Table X.

TABLE X

| X | Y | Dmin | Gamma | Rel. Speed |
|---|---|---|---|---|
| no dopant | | 0.27 | 0.94 | 100 |
| 1 | 30 | 0.23 | 0.95 | 110 |
| 30 | 60 | 0.19 | 0.94 | 118 |
| 1 | 60 | 0.20 | 0.88 | 122 |
| 60 | 90 | 0.21 | 0.97 | 108 |

From Table X it is apparent that the SET dopant increased photographic speed and lowered minimum density. Contrast was also increased, except when the amount of SET dopant was doubled by extending dopant introduction over the range of from 1 to 60 percent of the silver addition.

Example 11

This demonstrates the adsorption and photographic advantages to be realized by employing high iodide plates on the major faces of ultrathin (t<0.07 μm) host tabular grains.

Ultrathin Host Tabular Grain Emulsion UT-11

A silver iodobromide host tabular grain emulsion was prepared by first charging a reaction vessel with 1.25 g/L of oxidized gelatin, 0.625 g/L NaBr, 0.7 mL of a polyethylene glycol surfactant suspended with paraffin oil in a naphthenic distillate(NALCO 2341™) and 6 L of distilled water. The contents of the reaction vessel were adjusted to a pH of 1.8 at 45° C. Nucleation occurred during a five second period during which 1.67 m/L of $AgNO_3$ and 1.645 mole/L of NaBr and 0.02505 mole/L KI were each added at a rate of 110 mL/min. The temperature was then adjusted to 60° C. and held for nine minutes. An additional 100 g of oxidized gelatin were added to the reactor, and the pH was then adjusted to 5.85 with NaOH. Subsequently 0.098 mole of NaBr was introduced into the reaction vessel such that the pBr was brought to 1.84. A further pBr shift to 1.517 was produced by the single jet addition of 1.75 mole/L of NaBr at 61.3 mL/min for 1.5 minutes. The remainder of the emulsion was precipitated over a period of 66 minutes using a triple jet. This triple jet consisted of 1.60 mole/L of silver nitrate accelerated from 12.5 to 96 mL/minute, 1.75 mole/L of NaBr accelerated from 13.3 to 95.6 mL/minute, and 136.25 g Ag/L of a fine grain AgI Lippmann emulsion accelerated from 12.5 to 96 mL/min. The emulsion was then cooled to 40° C., iso-washed twice and adjusted to a pBr of 3.378 and a pH of 5.6.

The resulting AgIBr tabular grain emulsion contained 2.5% bulk iodide and had a grain size COV of 52 percent. The mean ECD of the emulsion grains was 2.9 μm, and the mean thickness of the grains was 46 nm. The average aspect ratio of the tabular grains was 63. Greater than 90 percent of total grain projected area was accounted for by tabular grains.

Host Tabular Grain Emulsion HT-2

This emulsion, described above, was employed to compare the absorption of the ultrathin tabular grain emulsion UT/HT-11 with a thicker host tabular grain emulsion.

UT-11+$AgI_{36}Br_{64}$(9.2M % I)

Silver iodobromide was precipitated on the major faces of a sample of the ultrathin tabular grains of UT/HT-11 in amount sufficient to provide an additional 9.2 mole % iodide.

UT-11+AgI(9.2M % I)

A high iodide phase was deposited on the major faces of a sample of the ultratin tabular grains of UT/HT-11 using the procedure used for the preparation of CT-2, but with the amount of additional AgI precipitated adjusted to 9.2M %, based on total silver.

UT-11+AgI(40M % I)

A high iodide phase was deposited on the major faces of a sample of the ultratin tabular grains of UT/HT-11 using the procedure used for the preparation of CT-2, but with the amount of additional AgI precipitated adjusted to 40M %, based on total silver.

UT-11+AgI(55M % I)

A high iodide phase was deposited on the major faces of a sample of the ultratin tabular grains of UT/HT-11 using the procedure used for the preparation of CT-2, but with the amount of additional AgI precipitated adjusted to 55M %, based on total silver.

Light Absorption Analysis

A sample of each of the emulsions above was coated at 10.76 mg/dm$^2$ silver with an equal volume of gelatin on a cellulose acetate photographic film support with an antihalation backing layer. The emulsion layer was overcoated with 21.53 mg/dm$^2$ of gelatin containing 1.5 percent, by weight, based on total gelatin, of bis(vinylsulfonyl)methane hardener.

Light absorption was determined as described above in Example 2. The results are shown below in Table XI.

TABLE XI

| Emulsion Sample | Integrated Light Absorption photons/sec/cm$^2$ |
|---|---|
| HT-2 | $294 \times 10^{10}$ |
| UT-11 | $317 \times 10^{10}$ |
| UT-11 + $AgI_{36}Br_{64}$(9.2 M% I) | $857 \times 10^{10}$ |
| UT-11 + AgI(9.2 M% I) | $966 \times 10^{10}$ |
| UT-11 + AgI(40 M% I) | $1545 \times 10^{10}$ |
| UT-11 + AgI(55 M% I) | $1778 \times 10^{10}$ |

Table XI demonstrates that the ultrathin tabular grains (UT-11) even without further iodide addition demonstrated higher absorptions than the host tabular grains HT-2, even though HT-2 contained a higher percentage of iodide than UT-11. When AgIBr containing a near-saturation level of iodide was deposited on the UT-11 tabular grains, absorption was increased markedly, but not to as great an extent as when the same amount of iodide was deposited as a high iodide phase.

Table XI further demonstrates that much higher levels of iodide can be deposited on the major faces of the host UT-11 tabular grains and that absorption is further markedly increased. This demonstrates the feasibility increasing the proportion of total silver deposited in the high iodide phase to near 60 percent.

Sensitometric Evaluation

Sensitometric evaluation of UT-11, UT-11+$AgI_{36}Br_{64}$(9.2M % I) and UT-11+AgI(9.2M % I) was conducted as described in Example 6 for 3000° K. exposures, except that sensitization of UT-11 was varied to achieve optimization as follows: The addition of 1.54 mmoles of NaSCN then 1.336 mmoles of spectral sensitizing dye SS-23 was followed by the addition of 0.034 mmole of N,N'-dicarboxymethyl-N,N'-dimethylthiourea and then 0.00439 mmole of Ag(I)bis(trimethylthiotriazole). A heat cycle of 7.5 minutes at 50° C. was employed. The sensitizations of emulsions UT-11+$AgI_{36}Br_{64}$(9.2M % I) and UT-11+AgI(9.2M % I) were identical to that of UT-11, except that the concentration of N,N'-dicarboxymethyl-N,N'-dimethylthiourea was reduced to 0.023 mmole. The sensitizations of the latter two emulsions were undertaken without further optimization, thereby providing a comparison favoring emulsion UT-11.

The performance of the emulsions is summarized in Table XII.

TABLE XII

| Emulsion | 3000° K. Dmin | Gamma | Speed |
|---|---|---|---|
| UT-11 | 0.08 | 2.31 | 100 |
| UT-11 | 0.1 | 0.62 | 38 |

TABLE XII-continued

| Emulsion | 3000° K. Dmin | Gamma | Speed |
|---|---|---|---|
| + $AgI_{36}Br_{64}$(9.2 M% I) | | | |
| UT-11 | 0.12 | 0.41 | 108 |
| + AgI(9.2 M% I) | | | |

From Table XII it is apparent that applying iodide to the face of the ultrathin tabular grains in the form of a AgIBr markedly decreased the speed of the emulsion. The reason for this was that the AgIBr could only be applied as a continuous shell over the exterior surface of the host tabular grains. On the other hand, the same amount of iodide deposited on the major faces of the host tabular grains as discrete plates left a large percentage of the host tabular grain surface unoccupied. This allowed the higher light absorption made possible by the high iodide plates to be translated into an increased photographic speed.

Example 12

This demonstrates the application of the invention to low (<5) aspect ratio tabular grain emulsions.

Low Aspect Ratio

Host Tabular Grain Emulsion LHT-12

An AgIBr low aspect ratio host tabular grain emulsion was prepared by first charging a reaction vessel with 1.5 g/L of oxidized gelatin, 0.6267 g/L NaBr, 0.15 g/L of the surfactant block copolymer A (see Example 1) and 6 L of distilled water. The contents of the reaction vessel were adjusted to a pH of 1.85 at 40° C. After a temperature adjustment to 45° C. nucleation occurred during a one minute period in which 0.8 mole/L of $AgNO_3$ and 0.84 mole/L of NaBr were each added at a rate of 97.2 mL/min. The halide excess in the reactor was increased by introducing an additional 0.115 mole of NaBr. The temperature was then adjusted to 60° C. over 9 minutes. A 9 minute ammoniacal digest ensued by the addition of 0.153 mole of ammonium sulfate activated by a pH adjustment to 9.5 by the addition of NaOH. An additional 100 g of oxidized gelatin were added to the reactor along with 1 g of block copolymer A, and pH was then adjusted to 5.85 with $HNO_3$. A first growth segment occurred over 5 minutes during which the $AgNO_3$ and KBr reagents used for nucleation were introduced each at 9 mL/min at a pBr of 1.776. A second growth segment occurred over a nine minute period at this pBr and temperature by introducing 1.6 mole/L $AgNO_3$ at a linearly accelerated rate of from 9 to 19 mL/min and 1.679 mole/L of NaBr at a linearly accelerated rate of from 4.7 to 16.9 mL/min. This was followed by a third growth segment of 54 minutes at an elevated pBr of 2.633 continuing with the same reactants, but at linearly accelerated rates of from 20.1 to 80 mL/min for $AgNO_3$ and 19.4 to 76.7 mL/min for NaBr. A final growth segment using the same reactants lasted 18.5 minutes at a constant flow rate of 80 mL/min. The emulsion was then cooled to 40° C., iso-washed twice and adjusted to a pBr of 3.378 and a pH of 5.5.

The resulting AgBr tabular grain emulsion had a grain size COV of 11 percent. The average ECD of the emulsion grains was 0.78 μm and the average thickness of the grains was 0.25 μm. The average aspect ratio of the tabular grains was 3. Greater than 90 percent of total grain projected area was accounted for by tabular grains.

Composite Tabular Grain Emulsion CT-12A

A 4 liter vessel was charged with one mole of host tabular grain emulsion and 1200 mL of distilled water, allowed to equilibrate at 40° C. for 10 minutes and then brought to a temperature of 65° C. The pBr was then raised from 3.681 to 5.261 during the first 3 minutes of a 15 minute segment in which a double jet addition of 0.25M $AgNO_3$ reagent was introduced at a linearly accelerated rate of from 2.3 to 11.6 mL/min while a 0.3M KI solution was introduced at a linearly accelerate rate of from 3.3 to 16.5 mL/min.

A second growth segment at the same pBr followed lasting 15 minutes in which the $AgNO_3$ was ramped from its final value in segment I to a value of 23.1 mL/min while the KI reagent flow rate was accelerated to 33 mL/min. The emulsion was subsequently iso-washed twice.

An overall bulk iodide content of 8.8 mole percent was found by neutron activation analysis. The silver iodide phase formed thin plates on the major faces of the host tabular grains. The plates consisted essentially of β phase AgI.

Composite Tabular Grain Emulsion CT-12B

This emulsion was prepared similarly as CT-12A, except that a higher bulk iodide level, 21.2 mole percent, based on total silver, was found by neutron activation analysis. The higher iodide content resulted from a 27.5 minute third growth segment of constant flow rates 23.1 and 33.0 mL/min for $AgNO_3$ and KI, respectively.

Composite Tabular Grain Emulsion CT-12C

This emulsion was prepared similar as CT-12B, except that a still higher bulk iodide level, 32.9 mole percent, based on total silver, was found by neutron activation analysis. The higher iodide content resulted from extending the third growth segment of CT-12B to 79.5 minutes.

Light Absorption Analysis

Two samples of each of the emulsions above, one without spectral sensitizing dye and one containing SS-23 at 433.2 mg/Ag mole, were coated at 10.76 mg/dm$^2$ silver with an equal volume of gelatin on a cellulose acetate photographic film support with an antihalation backing layer. The emulsion layer was overcoated with 21.53 mg/dm$^2$ of gelatin containing 1.5 percent, by weight, based on total gelatin, of bis(vinylsulfonyl)methane hardener.

Light absorption was determined as described above in Example 2. The results are shown below in Table XIII.

TABLE XIII

| Emulsion (Iodide M%) | Undyed Integrated Light Absorption photons/sec/cm$^2$ | SS-23 Integrated Light Absorption photons/sec/cm$^2$ |
|---|---|---|
| CT-12A (8.8) | $671.4 \times 10^{10}$ | $1076 \times 10^{10}$ |
| CT-12B (21.2) | $981.8 \times 10^{10}$ | $1191.2 \times 10^{10}$ |
| CT-12C (32.9) | $1111.7 \times 10^{10}$ | $1270.6 \times 10^{10}$ |

By comparison with Table II, which demonstrates absorptions, with and without SS-23, of 20.6 mole percent iodide on a high aspect ratio tabular grain host, it is apparent that the low aspect ratio tabular grain host was also effective to produce high levels of light absorption.

Example 13

This demonstrates emulsions according to the invention in which the host tabular grains are high chloride {100} tabular grains.

AgICl {100} Tabular Grain Host HT-13

A silver iodochloride {100} tabular grain emulsion was prepared by charging a reaction vessel with 1950 g of oxidized gelatin, 30 g of NaCl, 17.8 g of the surfactant S6 (see Example 6) and 45.5 L of distilled water. The contents of the reaction vessel were brought to 35° C. Nucleation occurred during a 1.28 minute period during which 4.0 mole/L of $AgNO_3$ (containing 95.5 mL/L of $HgCl_2$), hereafter referred to as the $AgNO_3$ solution, and 4.0 mole/L of NaCl, hereafter referred to as the salt solution, were reacted at a rate of 1100 mL/min and 1478 mL/min, respectively. The pCl was 2.0327. Additional water, 107 L, NaCl (22.26 g) and KI (6.54 g) were then introduced into the reaction vessel. Subsequently the pCl was brought to 2.3961. A first growth segment (I) then occurred over a period of 18 minutes during which the temperature was raised to 50° C. and $AgNO_3$ and salt solutions were double jetted at 129.5 and 173.9 mL/min, respectively. A second growth segment (II) took place over 20 minutes by continuing precipitation as described for growth segment I, except that the temperature was raised to 70° C., the pCl was lowered to 1.7914; and the $AgNO_3$ solution was ramped linearly to 194.3 mL/min while the salt solution was parabolically ramped from 260.9 to 173.9 mL/min. After a 15 minute hold, a third growth segment (III) was undertaken for 38 minutes during which the $AgNO_3$ solution flow rate was linearly ramped from 129.5 to 388.4 mL/min and the salt solution flow rate was regulated to maintain the contents of the reactor at a pCl of 1.8208. An additional 15 minute ripening period then ensued followed by a pCl adjustment to 1.3496. The emulsion was then cooled to 40° C. and adjusted to a pCl of 2.2622 during ultrafiltration. The pH of the emulsion was adjusted to 5.67.

The resulting AgICl {100} tabular grain emulsion contained 0.05M % iodide, based on total silver. The ECD of the emulsion grains was 2.59 μm, and the average thickness of the grains was 0.143 μm. The average aspect ratio of the tabular grains was 18.

Composite Tabular Grain Emulsion CT-13A

A 4 L reaction vessel was charged with one mole of the HT-13 emulsion, allowed to equilibrate at 40° C. for 5 minutes and then brought to a temperature of 65° C. The pCl was then raised from 1.5693 to 4.4322 during the first few minutes of a 15 minute segment in which a double jet addition of 0.25N $AgNO_3$ was introduced at a linearly accelerated rate of from 2.3 to 11.6 mL/min while 0.3M KI was introduced at a linear accelerated rate of from 3.3 to 16.5 mL/min. A second growth segment followed lasting 15 minutes in which the $AgNO_3$ solution addition rate was linearly accelerated from its final flow rate in segment I to a value of 23.1 mL/min while the KI solution addition rate was linearly accelerated to 33 mL/min. The emulsion was iso-washed twice, brought to a pH of 5.6 The iodide deposited on the host tabular grains amounted to 7.4M %, based on the total silver forming the composite grains.

Composite Tabular Grain Emulsion CT-13B

This emulsion was prepared similarly as CT-13A, except that the pCl during precipitation was maintained at 1.8978. This emulsion had an analyzed iodide content of 9.97M %, based on the total silver forming the composite grains.

Composite Tabular Grain Emulsion CT-13C

This emulsion was precipitated similarly as CT-13B, except that $AgNO_3$ and KI solutions were diluted to one-tenth their concentration and introduced for a single growth period of 22 minutes to add only 0.58M % iodide, based on total silver.

Composite Tabular Grain Emulsion CT-13D

This emulsion was precipitated similarly as emulsion CT-13A, but with pCl adjusted to 1.3001 during AgI precipitation and precipitation continued until 23.3M % I, based on total silver, had been precipitated. The entire exterior surface of the tabular grains was covered with the high iodide second phase.

Light Absorption Analysis

Samples of each of the emulsions prepared as described above and sensitized as described below and corresponding samples sensitized without spectral sensitizing dye SS-23 were coated at 10.76 mg/dm$^2$ silver with an equal volume of gelatin on a cellulose acetate photographic film support with an antihalation backing layer. The emulsion layer was overcoated with 21.53 mg/dm$^2$ of gelatin containing 1.5 percent, by weight, based on total gelatin, of bis(vinylsulfonyl-)methane hardener.

Light absorption was determined as described above in Example 2. The results are shown below in Table XIV.

TABLE XIV

| Emulsion (2nd phase M% I) [2nd phase pCl] | | Undyed Integrated Light Absorption photons/sec/cm$^2$ | SS-23 Integrated Light Absorption photons/sec/cm$^2$ |
|---|---|---|---|
| HT-13 | | $276.1 \times 10^{10}$ | $411.0 \times 10^{10}$ |
| CT-13A(7.4) | [4.4322] | $338.8 \times 10^{10}$ | $432.5 \times 10^{10}$ |
| CT-13B(10) | [1.8978] | $347.5 \times 10^{10}$ | $470.0 \times 10^{10}$ |
| CT-13C(0.58) | [1.8978] | $287.7 \times 10^{10}$ | $567.5 \times 10^{10}$ |
| CT-13D(23.2) | [4.4322] | $533.3 \times 10^{10}$ | $510.5 \times 10^{10}$ |

Each of the composite tabular grain emulsions exhibited a higher absorption than the host tabular grain emulsion, with or without SS-23 present.

Although the highest level of absorption without dye was realized by CT-13D, entirely covering the outer surface of the host tabular grains with AgI made this a poor emulsion in terms of sensitivity, as has been demonstrated in previous examples (see ST-5, Example 5).

In comparing the remaining composite tabular grain emulsions CT-13A, CT-13B and CT-13C, the highest level of absorption with dye present was achieved when the second phase contained only 0.58M % I. This was attributed a clear preference of spectral sensitizing dye SS-23 for aggregation with a minimum level of iodide present. This result is believed to be a function of the particular dye chosen. A different result would be expected with a different choice of spectral sensitizing dye. From a comparison of CT-13A and CT-13B it is believed that forming the second phase under conditions that result in minimum chloride inclusions in the second phase (that is, at a minimum chloride ion solubility pCl of ≈1.9) is important to enhancing light absorption. AgI can contain up to 9M % Cl at saturation. It is believed that chloride inclusion in AgI reduces its light absorption.

Sensitometric Evaluation

To a sample of each composite tabular grain emulsion were added at 40° C. in sequence the following reagents in millimoles per silver mole with 5 minute holds between each successive addition: 1.54 mmoles of NaSCN, 0.65 mmole of SS-23, 0.011 mmole of N,N'-dicarboxymethyl-N,N'-dimethylthiourea, 0.0022 mmole of Au(I) bis(trimethylthiotriazole), and 2.5 mg of 3-methyl-1,3-benzothiazolium iodide. Chemical sensitization was effected by raising the emulsion melt containing addenda to 50° C. and holding for 7.5 minutes. Subsequently, the melt was cooled to 40° C., and then prepared for coating.

Single emulsion layer coatings were formulated containing 10.76 mg/dm$^2$ of silver halide, 16.14 mg/dm$^2$ of gelatin, and 9.684 mg/dm$^2$ of the yellow dye-forming coupler YC-1. The dye-forming coupler containing emulsion layer also contained 1.75 g/Ag mole 4-hydroxy-6-methyl-1,3,3a,7-tetraazaindene and was overcoated with 8.608 gm/dm$^2$ of gelatin and hardened with 1.5 percent by weight of bis(vinylsulfonyl)methane.

Coatings were exposed through a 0–4 density step tablet for 1/50" using a Wratten 2B™ filter with a 0.6 density inconel filter and a 3200° K. color temperature (tungsten filament balance) light source. The Wratten 2B filter allowed transmission of light having a wavelength longer than 410 nm. A standard 3.25 min development color negative process (Eastman Color Negative™) was used to develop the latent image.

The results are summarized in Table XV.

TABLE XV

| Emulsion (2nd phase M% I) | [2nd phase pCl] | Dmin | Gamma | Relative Speed |
|---|---|---|---|---|
| HT-13 | | 0.73 | 1.58 | 100 |
| CT-13A(7.4) | [4.4322] | 0.57 | 0.74 | 160 |
| CT-13B(10) | [1.8978] | 0.16 | 1.14 | 126 |
| CT-13C(0.58) | [1.8978] | 0.31 | 2.33 | 147 |

CT-13D is not shown in Table XV, since covering the entire outer surface of the host tabular grains resulted in extremely low speed, attributable to development inhibition by iodide. Each of the composite tabular grain emulsions CT-13A, CT-13B and CT-13C satisfying the requirements of the invention showed a lower minimum density and a higher speed than the host tabular grain emulsion. This clearly demonstrates two of the photographic advantages that can be realized when the host tabular grains are high chloride {100} tabular grains.

What is claimed is:

1. A photographic emulsion comprised of a dispersing medium and radiation-sensitive silver halide grains with greater than 50 percent of total grain projected area being accounted for by grains containing a host portion of a face centered cubic rock salt crystal lattice structure and a first epitaxial phase containing greater than 90 mole percent iodide, wherein the host portion is tabular, being bounded by an exterior having first and second parallel major faces joined by a peripheral edge, the first epitaxial phase accounts for less than 60 percent of total silver, and the first epitaxial phase is restricted to a portion of the exterior of the host portion that includes at least 15 percent of the major faces.

2. A photographic emulsion according to claim 1 wherein the first epitaxial phase is restricted to a portion of the exterior of the host portion that includes at least 25 percent of the major faces.

3. A photographic emulsion according to claim 2 wherein the tabular host portion of the grains has an average aspect ratio of greater than 5.

4. A photographic emulsion according to claim 1 wherein the first epitaxial phase accounts for less than 25 percent of total silver.

5. A photographic emulsion according to claim 3 wherein the first epitaxial phase accounts for less than 10 percent of total silver.

6. A photographic emulsion according to claim 1 or 3 wherein the first epitaxial phase is restricted to less than 90 percent of the exterior of the tabular host portions of the grains.

7. A photographic emulsion according to claim 1 or 3 wherein the tabular host portions of the grains are comprised of greater than 50 mole percent chloride.

8. A photographic emulsion according to claim 7 wherein the host tabular grains have {100} major faces.

9. A photographic emulsion according to claim 1 or 3 wherein the tabular host portions of the grains have {111} major faces.

10. A photographic emulsion according to claim 1 or 3 wherein the tabular host portions of the grains are comprised of greater than 50 mole percent bromide.

11. A photographic emulsion according to claim 10 wherein the tabular host portions of the grains are silver bromide or iodobromide grains.

12. A photographic emulsion according to claim 10 wherein the radiation-sensitive grains additionally include second epitaxial portions forming epitaxial junctions with the peripheral edges of the tabular host portions.

13. A photographic emulsion according to claim 12 wherein the radiation-sensitive grains additionally include second epitaxial portions containing greater than 50 mole percent chloride forming epitaxial junctions with the peripheral edges of the tabular host portions.

14. A photographic emulsion according to claim 1 or 3 wherein the emulsion additionally includes a spectral sensitizing dye adsorbed to the radiation-sensitive silver halide grains.

15. A photographic emulsion according to claim 14 wherein the spectral sensitizing dye has a reduction potential more negative than −1.30 volts.

16. A photographic emulsion according to claim 15 wherein the spectral sensitizing dye has a reduction potential more negative than −1.35 volts.

17. A photographic emulsion according to claim 14 wherein the spectral sensitizing dye exhibits a maximum absorption in the blue region of the spectrum.

18. A photographic emulsion according to claim 17 wherein the spectral sensitizing dye exhibits a maximum absorption in the spectral region between 450 and 500 nm.

19. A photographic emulsion according to claim 1 or 3 wherein the grains contain a photographically useful dopant.

20. A photographic emulsion according to claim 19 wherein the dopant is a shallow electron trapping dopant.

* * * * *